US011760083B2

(12) United States Patent
Komamiya et al.

(10) Patent No.: US 11,760,083 B2
(45) Date of Patent: Sep. 19, 2023

(54) PRINTING POSITION CORRECTION METHOD, PRINTING APPARATUS, AND STORAGE MEDIUM

(71) Applicant: CANON KABUSHIKI KAISHA, Tokyo (JP)

(72) Inventors: Yumi Komamiya, Kanagawa (JP); Shingo Okushima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 17/506,814

(22) Filed: Oct. 21, 2021

(65) Prior Publication Data

US 2022/0134735 A1 May 5, 2022

(30) Foreign Application Priority Data

Oct. 30, 2020 (JP) ..... 2020-182932

(51) Int. Cl.
*B41J 2/045* (2006.01)

(52) U.S. Cl.
CPC ..... *B41J 2/04505* (2013.01); *B41J 2/04563* (2013.01); *B41J 2/04586* (2013.01)

(58) Field of Classification Search
CPC .. B41J 2/0457; B41J 2/04571; B41J 2/04573; B41J 2/04538; B41J 2/0454; B41J 2/0452; B41J 2/04525; B41J 2/04556; B41J 2/04558; B41J 2/0456; B41J 2/04561; B41J 2/1404; B41J 2/14072; B41J 2/1408; B41J 2/04505; B41J 2/04563; B41J 2/04586; B41J 2/0458
See application file for complete search history.

(56) References Cited

U.S. PATENT DOCUMENTS

| | | | | |
|---|---|---|---|---|
| 5,966,149 | A | 10/1999 | Kamada et al. | |
| 10,350,885 | B2 | 7/2019 | Aoki et al. | |
| 10,384,474 | B2 | 8/2019 | Hirokawa et al. | |
| 10,654,300 | B2 | 5/2020 | Okushima et al. | |
| 10,696,050 | B2 | 6/2020 | Takada et al. | |
| 2003/0058294 | A1* | 3/2003 | Butterfield | B41J 29/393 347/19 |
| 2006/0125861 | A1* | 6/2006 | Silverbrook | B41J 2/04541 347/42 |
| 2009/0237437 | A1* | 9/2009 | Uchida | B41J 2/1752 347/16 |
| 2018/0244090 | A1* | 8/2018 | Liu | B41J 2/04505 |

FOREIGN PATENT DOCUMENTS

JP H10-044423 A 2/1998

* cited by examiner

*Primary Examiner* — Kristal Feggins
(74) *Attorney, Agent, or Firm* — Venable LLP

(57) ABSTRACT

Misalignment of printing positions is reduced in a print head that circulates an ink between a printing apparatus and the print head in a case where the misalignment is apt to change dynamically along with heat deformation. To this end, printing element substrates in the print head are adjusted to a target temperature and then a liquid is circulated through the print element substrates. After thermal expansion of the print head reaches a steady state, an amount of misalignment of printing positions in a direction of conveyance of the print head is obtained by using a test pattern printed by using printing elements. Further, a correction value for correcting the misalignment of the printing positions is set based on the obtained amount of misalignment of the printing positions.

19 Claims, 24 Drawing Sheets

PRINTING POSITION CORRECTION METHOD, PRINTING APPARATUS, AND STORAGE MEDIUM

BACKGROUND OF THE INVENTION

Field of the Invention

The present disclosure relates to a printing position correction method, a printing apparatus, and a storage medium.

Description of the Related Art

There is an elongate inkjet print head to be mounted on a line-type printing apparatus, which is formed by joining multiple ejection modules. This elongate print head may cause misalignment of the ejection modules in a lateral direction that intersects with a longitudinal direction, thus leading to an image deterioration.

Japanese Patent Laid-Open No. H10-44423 discloses a method of reducing misalignment of printing positions in a lateral direction by adjusting ejection timing of printing elements arranged in a longitudinal direction.

SUMMARY OF THE INVENTION

In a first aspect of the present disclosure, there is provided a printing position correction method applied to a printing apparatus configured to use a print head including a plurality of printing element substrates in which a plurality of printing elements are continuously arranged in a first direction, and to print an image on a print medium being conveyed in a second direction intersecting with the first direction, the method being designed to correct a printing position in the second direction, comprising: an obtaining step of adjusting the plurality of printing element substrates in the print head to a target temperature, circulating a liquid through the printing element substrates in the print head, and obtaining an amount of misalignment of printing positions in the second direction of the print head by using a test pattern printed on the print medium being conveyed in the second direction by driving the printing elements in the print head after thermal expansion of the print head reaches a steady state; and a setting step of setting a correction value based on the amount of misalignment of the printing positions.

In a second aspect of the present disclosure, there is provided a printing apparatus comprising: a print head including a plurality of printing element substrates in which a plurality of printing elements are continuously arranged in a first direction; a temperature adjustment unit configured to adjust a temperature of the printing element substrates in the print head; a circulation unit configured to circulate a liquid in the printing element substrates in the print head; a driving unit configured to drive the plurality of printing elements in the print head to cause the printing elements to eject the liquid; a conveyance unit configured to convey a print medium in a second direction intersecting with the first direction; an obtaining unit configured to obtain an amount of misalignment of printing positions in the second direction of the print head by using a test pattern printed on the print medium being conveyed by the conveyance unit by causing the driving unit to drive the printing elements in the print head after the temperature adjustment unit adjusts the printing element substrates in the print head to a target temperature, the circulation unit circulates the liquid through the printing element substrates in the print head, and thermal expansion of the print head reaches a steady state; and a setting unit configured to set a correction value based on the amount of misalignment of the printing positions.

In a third aspect of the present disclosure, there is provided a non-transitory computer-readable storage medium storing a program for causing a computer to execute a printing position correction method, the printing position correction method comprising: an obtaining step of adjusting the plurality of printing element substrates in the print head to a target temperature, circulating a liquid through the printing element substrates in the print head, and obtaining an amount of misalignment of printing positions in the second direction of the print head by using a test pattern printed on the print medium being conveyed in the second direction by driving the printing elements in the print head after thermal expansion of the print head reaches a steady state; and a setting step of setting a correction value based on the amount of misalignment of the printing positions.

Further features of the present disclosure will become apparent from the following description of exemplary embodiments with reference to the attached drawings.

DESCRIPTION OF THE EMBODIMENTS

Although the method according to Japanese Patent Laid-Open No. H10-44423 can correct the misalignment of the printing positions attributable to a static configuration of the print head, this method can hardly correct misalignment of the printing positions associated with a dynamic deformation of the print head. Particularly, in the case of a print head configured to circulate an ink between the print head and the printing apparatus in order to maintain a normal ejecting operations, heat distribution in the print head due to the heat of the ink circulated inside the print head and heat deformation associated with this heat distribution may dynamically change. These dynamic changes are likely to complicate the correction of the misalignment of the printing positions.

The present disclosure has been made to solve the aforementioned problem. An object of the present disclosure is to reduce misalignment of printing positions in a print head configured to circulate an ink between a printing apparatus and the print head in a case where the misalignment is apt to change dynamically along with heat deformation.

First Embodiment

<Overall Configuration of Printing Apparatus>

Figure 1A:
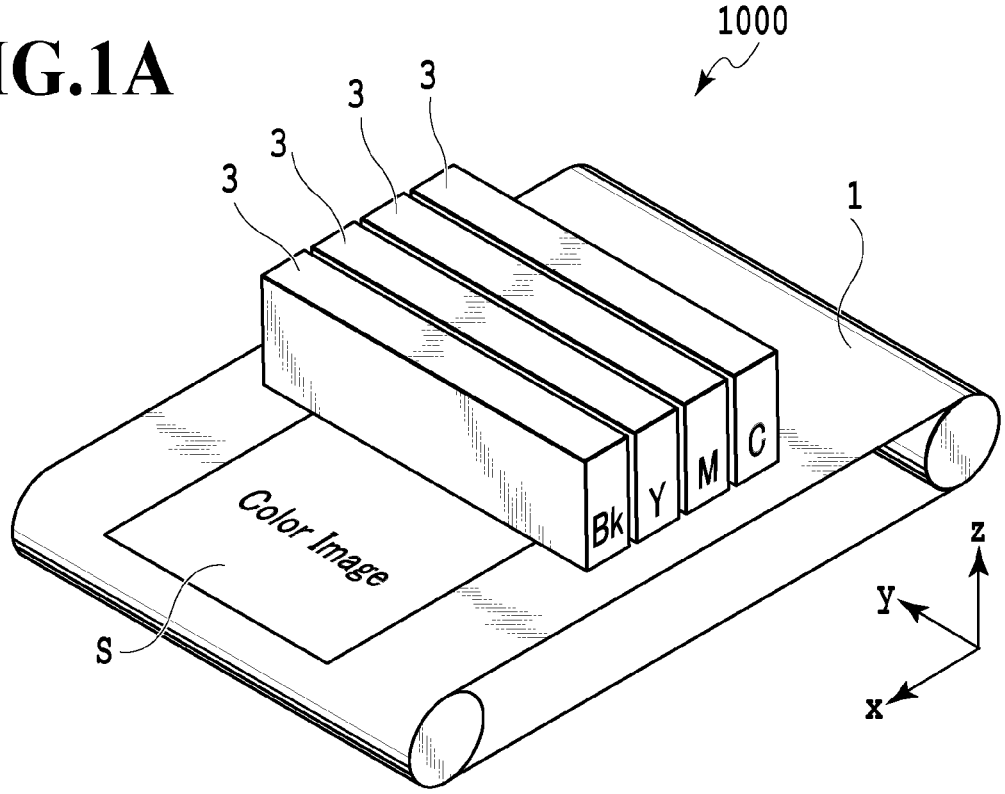
FIGS. 1A and 1B are diagrams showing examples of a printing apparatus.
Figure 1B:
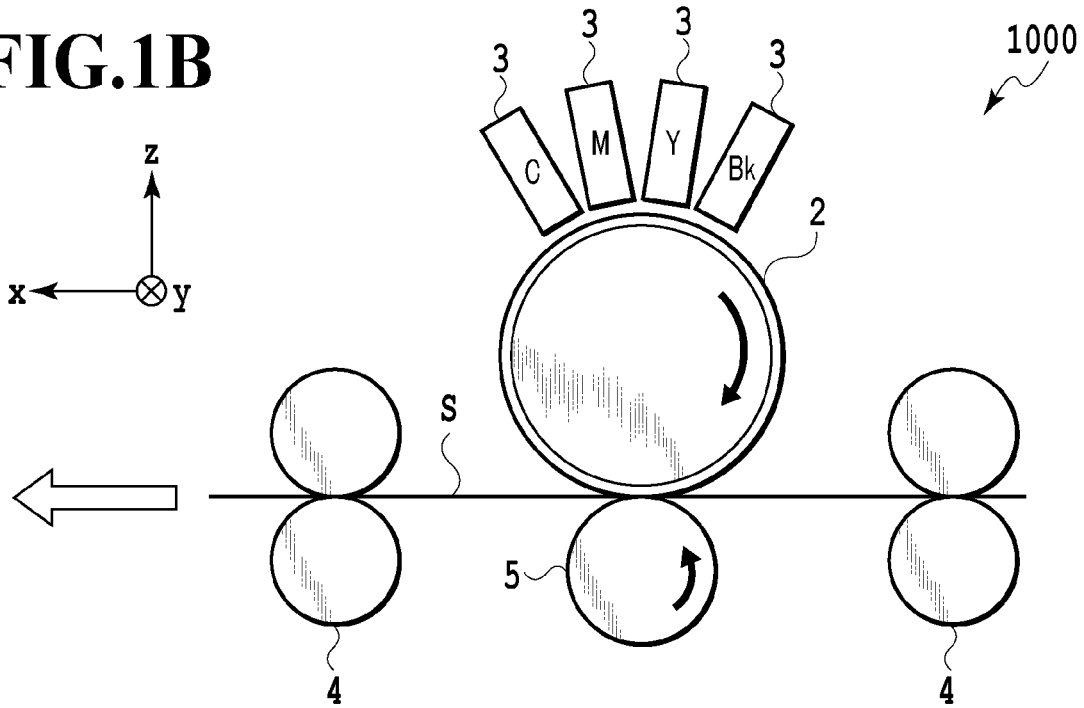

FIGS. 1A and 1B are diagrams showing examples of a printing apparatus usable in the present embodiment. The printing apparatus of the present embodiment is an inkjet printing apparatus (hereinafter simply referred to as the printing apparatus) 1000, which prints a color image on a print medium S by ejecting cyan (C), magenta (M), yellow (Y), and black (Bk) inks. In FIGS. 1A and 1B, x direction is a direction of conveyance of the print medium S, y direction is a width direction of the print medium, and z direction is a vertically upward direction.

FIG. 1A shows the printing apparatus 1000 in which liquid ejection heads (hereinafter referred to as print heads) 3 directly eject inks to the print medium S being conveyed in the x direction. The print medium S is loaded on a conveyance unit 1 and conveyed in the x direction below four print heads 3 that eject inks of different colors, respectively, at a predetermined velocity. In FIG. 1A, the four print heads 3 are arranged in the order of cyan, magenta, yellow, and black in the x direction, whereby the inks are applied to the print medium S in the order of the colors mentioned above. In each print head 3, ejection ports to eject the ink are arranged in the y direction.

FIG. 1B shows the printing apparatus 1000 configured such that the inks of the four colors ejected from the print heads 3 are transferred to the print medium S via an intermediate transfer drum 2. The four print heads 3 that eject the inks of mutually different colors are arranged such that ejection port surfaces thereof are opposed to a surface of the intermediate transfer drum 2. In a case where the print medium S being conveyed in the x direction by conveyance rollers 4 passes through a nipped portion between the intermediate transfer drum 2 and a transfer roller 5, the inks attached to the intermediate transfer drum 2 are transferred to the print medium S. The print heads 3 of the present embodiment may be used in any of the printing apparatuses 1000 of FIGS. 1A and 1B.

Although cut paper is shown as the print medium S in FIGS. 1A and 1B, a print medium S2 may be continuous paper fed from rolled paper.

Figure 2:
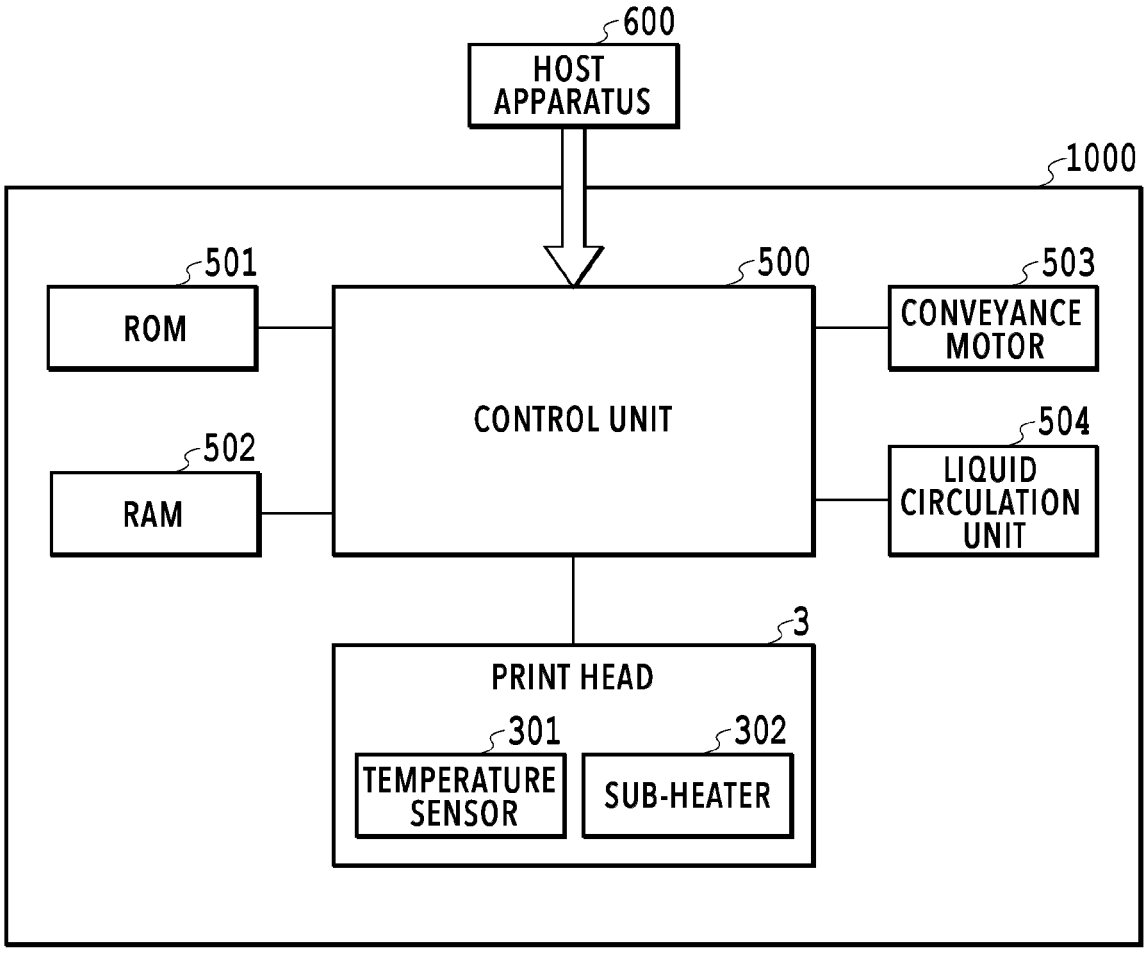
FIG. 2 is a block diagram for explaining a control configuration.

FIG. 2 is a block diagram for explaining a control configuration of the printing apparatus 1000. A control unit 500 is formed from a CPU or the like. The control unit 500 controls the entire printing apparatus 1000 in accordance with programs and various parameters stored in a ROM 501 while using a RAM 502 as a work area. The control unit 500 subjects image data, which is received from an externally connected host apparatus 600, to prescribed image processing in accordance with the programs and the parameters stored in the ROM 501, thereby generating ejection data that can be used by the print heads 3. Then, the control unit 500 drives the print heads 3 in accordance with the ejection data and causes the print heads 3 to eject the inks at a predetermined frequency.

In the course of ejecting operations by the print heads 3, the control unit 500 drives a conveyance motor 503 to convey the print medium S in the x direction at a velocity corresponding to the drive frequency of the head. In this way, an image in accordance with the image data received from the host apparatus 600 is printed on the print medium S. Information on a usage area concerning the ejection ports used for ejection from the print head 3 is rewritably stored in the ROM 501 in terms of each of the print heads 3. A method of setting the usage area will be described later in detail.

Although it is not shown in FIG. 2, printing element substrates 10 (see FIGS. 3 and 4) are arranged on each print head 3. Moreover, each printing element substrate 10 is provided with a plurality of temperature sensors 301 for detecting temperatures of the printing element substrate 10 and with a plurality of sub-heaters 302 for heating the printing element substrate 10 to a preset temperature, respectively. FIG. 2 shows the plurality of temperature sensors 301 and the plurality of sub-heaters 302 collectively so as to simplify the explanation. In the case of carrying out a printing operation, the control unit 500 drives the sub-heaters 302 based on the temperatures detected by the temperature sensors 301, thereby heating and keeping the respective printing element substrates 10 at an appropriate temperature. In the present embodiment, each printing element substrate 10 is assumed to be heated and kept at 65° C. in a general printing operation.

Liquid circulation units 504 are units for supplying liquids (the inks) to the print heads 3 while circulating the liquids. The liquid circulation units 504 control systems for circulating the inks under control of the control unit 500. FIG. 2 illustrates the print head 3 and the liquid circulation unit 504 for one of the colors for the sake of simplification. In reality, however, the print heads 3 and the liquid circulation units 504 for the four colors are controlled by the control unit.

<Ink Circulation System>

Figure 3A:
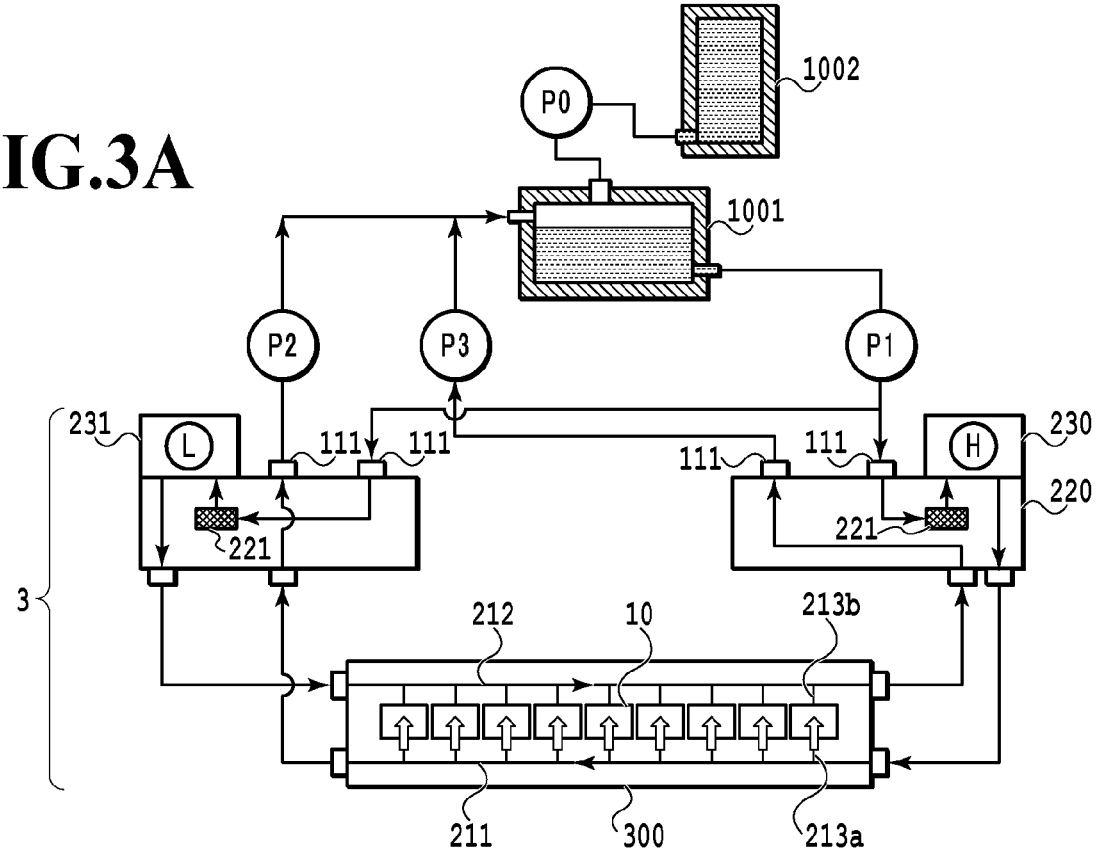
FIGS. 3A and 3B are diagrams for explaining ink circulation systems.
Figure 3B:
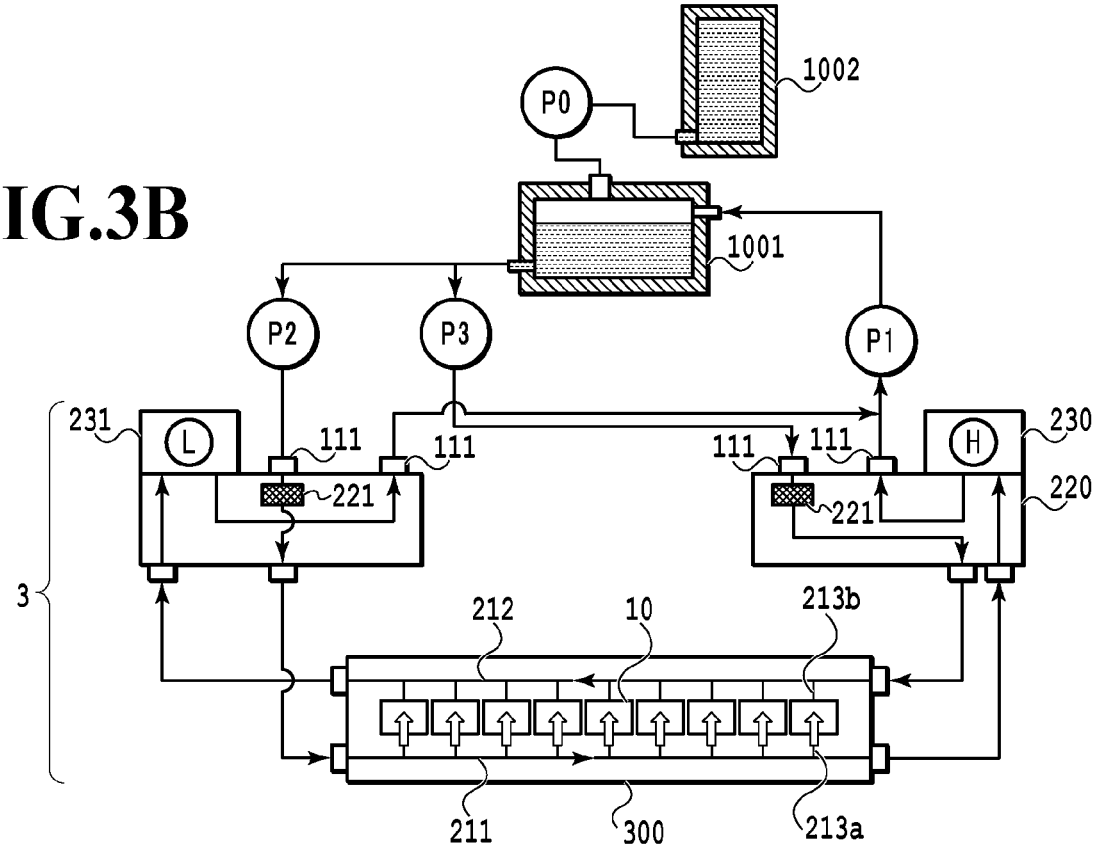

FIGS. 3A and 3B are diagrams for explaining ink circulation systems to be controlled by the liquid circulation unit 504.

In each of the FIGS. 3A and 3B, the ink put in a buffer tank 1001 is supplied to the print head 3 and the ink not consumed by the ejection is collected by the buffer tank

1001. In other words, the ink is circulated between the buffer tank 1001 and the print head 3. In the case where the ink stored in the buffer tank 1001 falls below a predetermined amount, a refill pump P0 is driven to refill the buffer tank 1001 with the ink stored in a main tank 1002. The buffer tank 1001 is provided with an air communication port (not shown), and bubbles included in the ink collected from the print head 3 rise up to a liquid surface due to buoyancy and are then released to outside air.

The print head 3 of the present embodiment includes an ejection unit 300 that ejects the ink in accordance with the ejection data, and two liquid supply units 220 for adjusting a pressure of the ink supplied to the ejection unit 300. The two liquid supply units 220 are provided with a first negative pressure control unit 230 and a second negative pressure control unit 231, respectively, for controlling the pressure of the ink flowing in the ejection unit 300.

FIG. 3A shows an example in which the first negative pressure control unit 230 and the second negative pressure control unit 231 are located upstream of the ejection unit 300 in the flow of the ink. The ink stored in the buffer tank 1001 is taken out with a first circulation pump P1, and then bifurcated and supplied to the liquid supply units 220 on the right and left sides. The supplied ink is fed to the first negative pressure control unit 230 and the second negative pressure control unit 231 through filters 221, respectively.

A control pressure in the first negative pressure control unit 230 is set to a small negative pressure (a negative pressure with a small difference in pressure from an atmospheric pressure). A control pressure in the second negative pressure control unit 231 is set to a large negative pressure (a negative pressure with a large difference in pressure from the atmospheric pressure). A pressure realized with the first negative pressure control unit 230 is higher (with a lower negative pressure) than a pressure realized with the second negative pressure control unit 231. Accordingly, the first negative pressure control unit 230 is indicated with H and the second negative pressure control unit 231 is indicated with L in FIG. 3A.

The ink with the pressure adjusted by the first negative pressure control unit 230 is collected to the buffer tank 1001 through a common supply flow passage 211 of the ejection unit 300 with suction power of a second circulation pump P2. The ink with the pressure adjusted by the second negative pressure control unit 231 is collected to the buffer tank 1001 through a common collection flow passage 212 of the ejection unit 300 with suction power of a third circulation pump P3. The pressures adjusted by the first negative pressure control unit 230 and the second negative pressure control unit 231 are maintained in an appropriate range by driving the second circulation pump P2 and the third circulation pump P3.

Amounts of the liquid flowing in the common supply flow passage 211 and the common collection flow passage 212 vary depending on a frequency of ejection of the ink from the ejection unit 300, or in other words, depending on a duty of the image. By locating the first negative pressure control unit 230 and the second negative pressure control unit 231 upstream of the ejection unit 300 as in the present embodiment, the pressure of the ink in the ejection unit 300 can be maintained at a certain range irrespective of the duty of the image.

The printing element substrates 10 are arranged in the ejection unit 300 in the direction of extension (the y direction) of the common supply flow passage 211 and the common collection flow passage 212. Each printing element substrate 10 is connected to the common supply flow passage 211 through an individual supply flow passage 213*a* and is connected to the common collection flow passage 212 through an individual collection flow passage 213*b*. Since there is a difference in pressure between the ink flowing in the common supply flow passage 211 and the ink flowing in the common collection flow passage 212, a flow of the ink from the individual supply flow passage 213*a* to the individual collection flow passage 213*b* is generated in each printing element substrate 10.

In the above-described configuration of the ink circulation, the first circulation pump P1 is preferably a pump that can gain at least a predetermined lift pressure within the range of an ink circulation flow rate achieved in the case of driving the ejection unit 300. A turbo pump, a displacement pump, and the like can be used as the first circulation pump P1. To be more precise, a diaphragm pump or the like is applicable. Instead of the first circulation pump P1, it is also possible to use a water head tank that is located to ensure a certain water head difference relative to the first negative pressure control unit 230 and the second negative pressure control unit 231.

A displacement pump having a quantitative liquid feeding capacity can be used as the second circulation pump P2 and the third circulation pump P3. Specific examples of such a displacement pump include a tube pump, a gear pump, a diaphragm pump, a syringe pump, and the like. Instead, it is also possible to adopt a mode of ensuring a constant flow rate by providing a general constant flow rate valve or a general relief valve at an outlet of a pump.

A mechanism similar to a so-called "decompression regulator" can be adopted to the first negative pressure control unit 230 and the second negative pressure control unit 231. In the case of using the decompression regulator, the first circulation pump P1 is preferably located in such a way as to apply the pressure to the upstream side of the first negative pressure control unit 230 and the second negative pressure control unit 231 as shown in FIG. 3A. In this way, it is possible to suppress an effect of a water head pressure of the buffer tank 1001 on the ejection unit 300, and thus to enhance the degree of layout freedom of the buffer tank 1001 in the printing apparatus 1000.

In the ejection unit 300 shown in FIG. 3A, a predetermined amount of the ink flows in each printing element substrate 10 irrespective of the presence of the ejection data as long as the printing apparatus 1000 is performing the printing operation. This configuration makes it possible to suppress an increase in viscosity of the ink at an ejection port with a lower frequency of ejection or to discharge the ink increased in viscosity or a foreign substance from the ejection unit 300. Moreover, as shown in FIG. 3A, by reversing the direction of the flow of the ink in the common supply flow passage 211 and the direction of the flow of the ink in the common collection flow passage 212, it is possible to accelerate heat exchange between these flow passages that are opposed to each other. As a consequence, it is possible to reduce a temperature gradient in a longitudinal direction (y direction) in the print head 3 and to suppress unevenness in ejecting amount among the printing element substrates 10.

Nevertheless, if the flow rate of the ink in the ejection unit 300 is set to a very large value, differences in negative pressure among the printing element substrates 10 may be increased due to pressure losses inside the flow passages whereby unevenness in density may develop on an outputted image. In this regard, the flow rate of the ink in the ejection unit 300 is preferably adjusted to an appropriate level in accordance with the degrees of the increase in viscosity at any ejection port with a lower ejection frequency, and of unevenness in temperature as well as pressure losses among the printing element substrates 10.

FIG. 3B shows an example in which the first negative pressure control unit 230 and the second negative pressure control unit 231 are located downstream of the ejection unit 300 in the flow of the ink. The configuration shown in FIG. 3B also has the effects substantially the same as those described with reference to FIG. 3A. A description will be given below of differences from the configuration shown in FIG. 3A.

In FIG. 3B, the ink flows in opposite directions from those indicated in FIG. 3A. Specifically, the ink stored in the buffer tank 1001 is supplied to the common supply flow passage 211 of the ejection unit 300 by the second circulation pump P2, and is supplied to the common collection flow passage 212 of the ejection unit 300 by the third circulation pump P3. The ink that passes through the common supply flow passage 211 is collected by the buffer tank 1001 through the first negative pressure control unit 230 by means of the first circulation pump P1 that functions as a negative pressure source. The ink that passes through the common collection flow passage 212 is collected by the buffer tank 1001 through the second negative pressure control unit 231 by means of the first circulation pump P1 that functions as the negative pressure source.

A mechanism similar to a so-called "back pressure regulator" can be adopted to the first negative pressure control unit 230 and the second negative pressure control unit 231 in FIG. 3B. By providing the first negative pressure control unit 230 and the second negative pressure control unit 231 each serving as the back pressure regulator downstream of the ejection unit 300, it is possible to maintain the pressure of the ink in the ejection unit 300 within a predetermined range irrespective of the duty of the image. As with the configuration in FIG. 3A, the configuration in FIG. 3B can also suppress the effect of the water head pressure of the buffer tank 1001 on the ejection unit 300. Thus, it is possible to enhance the degree of layout freedom of the buffer tank 1001 in the printing apparatus 1000.

In the case of the configuration shown in FIG. 3B, the ink supplied from the buffer tank 1001 is directly supplied to the ejection unit 300 through the filter 221. For this reason, even if there is dust or a foreign substance in the first negative pressure control unit 230 or the second negative pressure control unit 231, such dust or a foreign substance is kept from entering the liquid ejection unit.

Moreover, in the case of the configuration shown in FIG. 3B, a maximum value of the flow rate of the ink sent from the buffer tank 1001 to the ejection unit 300 can be controlled less than that in the configuration of FIG. 3A. Here is the reason why.

First, a flow rate necessary for circulating the ink in the ejection unit 300 in a state of not involving the ejecting operation will be defined as a flow rate Qa. The flow rate Qa is defined as a minimum required flow rate for maintaining the ejection unit 300 at an appropriate temperature in the case where the printing apparatus 1000 is in a standby state. Meanwhile, a flow rate of the ink consumed by the ejection unit 300 in a state of performing the ejecting operation at a maximum frequency with all the ejection ports will be defined as a flow rate Qb.

In the case of the configuration shown in FIG. 3A, a sum of set flow rates of the second circulation pump P2 on a high pressure side and the third circulation pump P3 on a low pressure side is equal to the flow rate Qa. Accordingly, in the case of performing the ejecting operation at the maximum frequency with all the ejection ports, a maximum value of the amount of ink supply to the ejection unit 300 is calculated as Qa+Qb. On the other hand, in the case of the configuration shown in FIG. 3B, the sum of set flow rates of the second circulation pump P2 on the high pressure side and the third circulation pump P3 on the low pressure side only needs to be a larger one of the flow rate Qa or the flow rate Qb. In other words, the configuration shown in FIG. 3B can reduce a total amount of circulation of the ink, and eventually, power of the pump as compared to the configuration shown in FIG. 3A, thereby enhancing the degree of freedom of the applicable circulation pump as a consequence. Moreover, this effect becomes more prominent as the value Qa or Qb becomes larger, or in other words, as the size of a line head becomes larger.

On the other hand, in the case of the configuration shown in FIG. 3B, the negative pressure to be applied to each nozzle is larger than that in the configuration shown in FIG. 3A, and satellites may be more conspicuous in the outputted image in some cases. This is due to the following reason. Specifically, in the case of the configuration shown in FIG. 3B, since the maximum value of the flow rate of the flow in the ejection unit 300 is equal to the flow rate of the flow in the state of not performing the ejecting operation, the negative pressure to be applied to each ejection port grows larger as the duty of the image is lower. For this reason, the satellites may develop at the respective ejection ports even in the case of the image with the low duty, and the satellites are more conspicuous as the duty of the image is lower. This tendency becomes more significant in the case where widths of the common supply flow passage 211 and the common collection flow passage 212 are reduced in order to downsize the liquid ejection head. In contrast, in the configuration shown in FIG. 3A, the negative pressure to be applied to each nozzle grows larger in the case of a high duty. However, even if satellites develop in this case, such satellites are less conspicuous in the image having the high duty.

The configuration of ink circulation of the present embodiment may adopt any one of those illustrated in FIGS. 3A and 3B while taking into account the respective features described above. Although FIGS. 3A and 3B illustrate the configurations of ink circulation in terms of the ink of one color, the same configurations are provided for the ink of each of the colors in reality. In the meantime, the direction of the flow of the liquid in the common supply flow passage 211 and the direction of the flow of the liquid in the common collection flow passage 212 are assumed to be mutually opposite directions in order to reduce the temperature gradient in the longitudinal direction (the y direction) inside the print head 3. However, these directions may be set to the same direction.

<Configuration of Print Head>

Figure 4A:
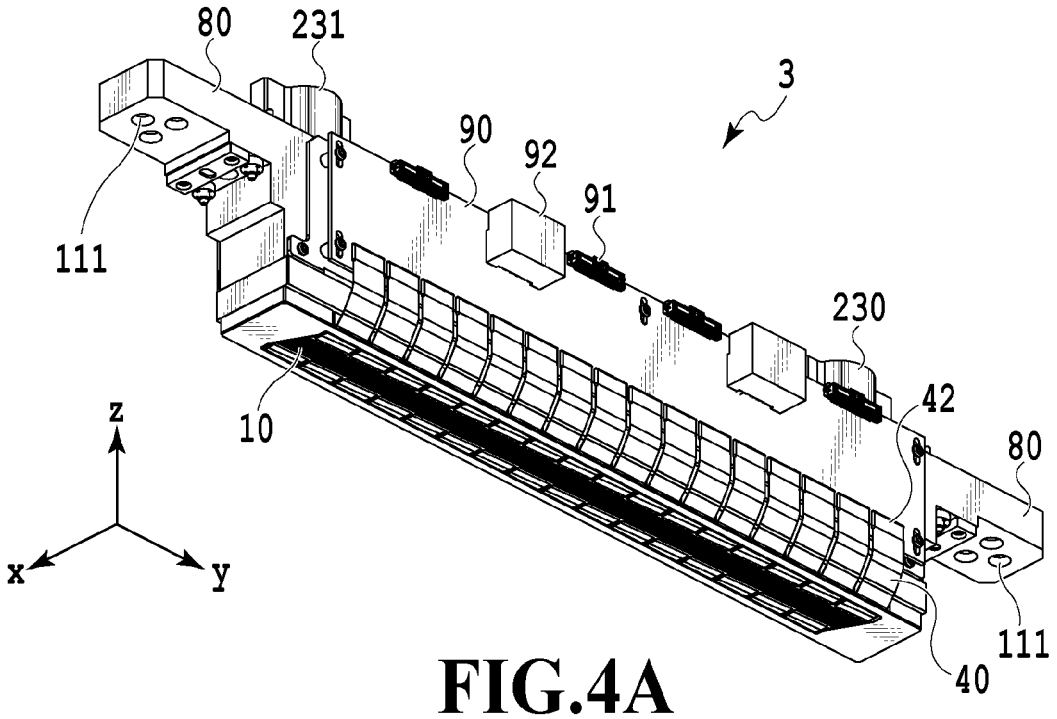
FIGS. 4A and 4B are external perspective views of a print head.
Figure 4B:
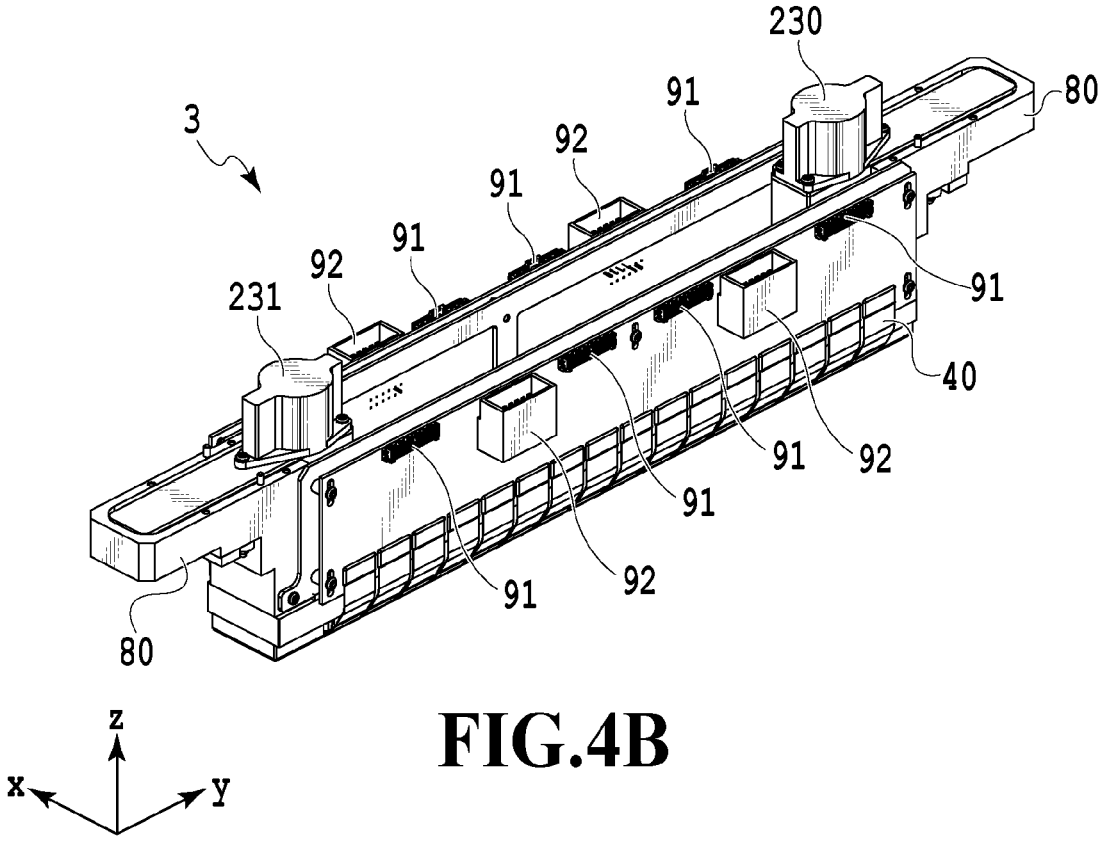

FIGS. 4A and 4B are external perspective views of the print head 3 usable in the present embodiment. FIG. 4A is a diagram viewing the print head 3 from obliquely downward while FIG. 4B is a diagram viewing the print head 3 from obliquely upward. Print head support portions 80 for securing rigidity are provided on two sides in the y direction being the longitudinal direction of the print head 3, and the liquid supply unit 220 described with reference to FIGS. 3A and 3B is housed in each of the two print head support portions 80. In FIGS. 4A and 4B, the first negative pressure control unit 230 and the second negative pressure control unit 231 project upward (+z direction) from the print head support portions 80. A liquid connecting portion 111 to be connected to the buffer tank 1001 is provided on a lower surface of each print head support portion 80.

The printing element substrates 10 are arranged on a lower surface of the print head 3 for such a distance that can deal with a width of the A3 size in the y direction. Twenty rows of ejection ports each formed by arranging the ejection ports in the y direction are arranged in the x direction on each printing element substrate 10 (see FIG. 10).

Electric wiring boards 90 that extend in the y direction are arranged on side surfaces on two sides in the x direction being the lateral direction of the print head 3. Each printing element substrate 10 is connected to the electric wiring boards 90 on the two sides through flexible wiring substrates 40. Each electric wiring board 90 is provided with two power supply terminals 92 for receiving electric power from a main body of the printing apparatus 1000, and four signal input terminals 91 for receiving ejection signals. Consolidation of the wiring inside the electric wiring boards 90 by using electric circuits makes it possible to reduce the numbers of the signal input terminals 91 and the power supply terminals 92 less than the number of the printing element substrates 10, thereby simplifying connection work in the case of attaching and detaching the print head 3 to and from the printing apparatus 1000.

Figure 5:
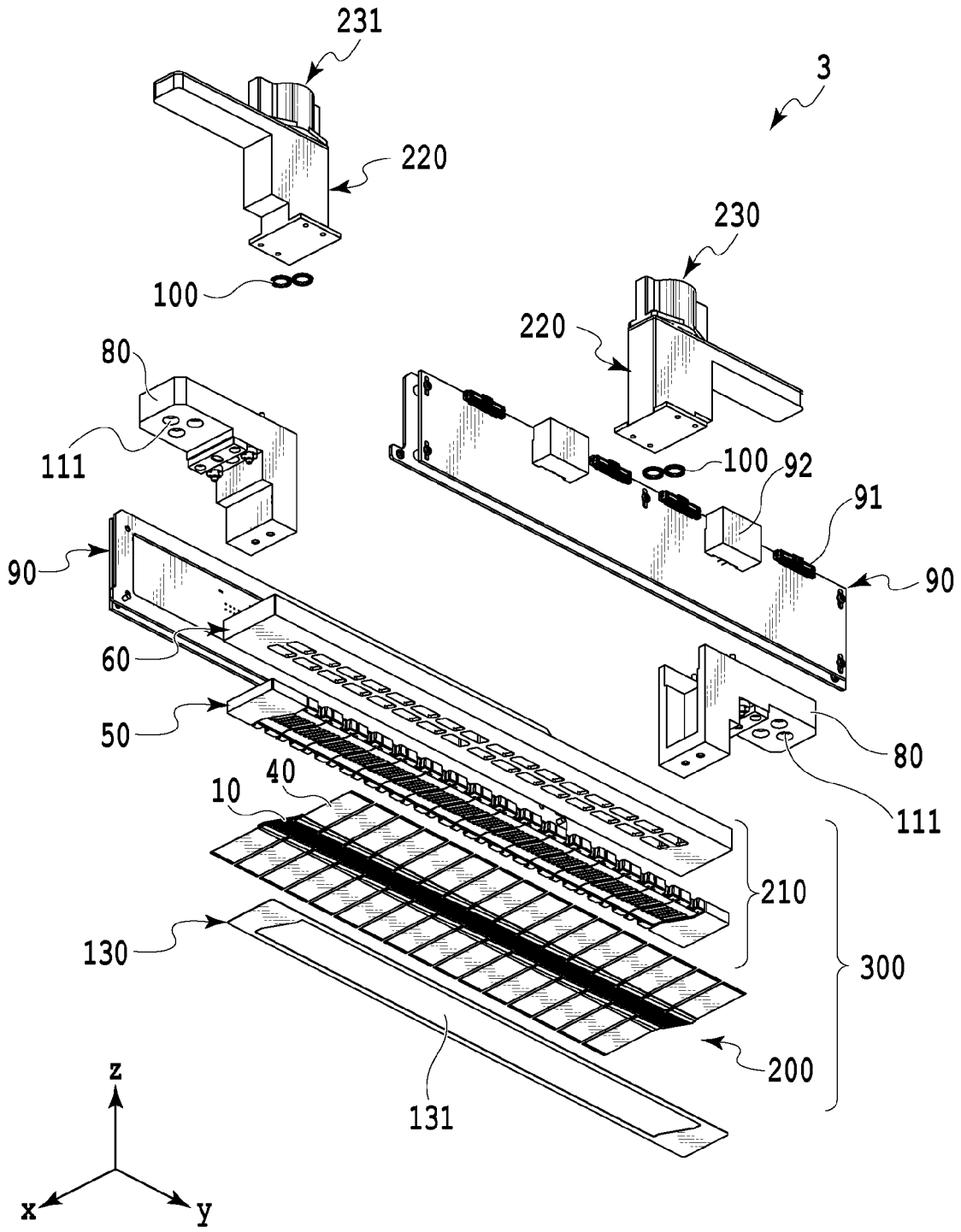
FIG. 5 is an exploded perspective view of the print head.

FIG. 5 is an exploded perspective view of the print head 3. The print head 3 mainly includes the liquid supply unit 220, the electric wiring boards 90, the print head support portions 80, and the ejection unit 300. The ejection unit 300 includes a flow passage member 210 for circulating the ink in the respective printing element substrates 10, ejection modules 200 formed from the printing element substrates 10 and the flexible wiring substrates 40, and a cover member 130 that covers the outer periphery of the ejection modules 200.

The flow passage member 210 includes a first flow passage member 50 that is fluidically connected to the printing element substrates 10, and a second flow passage member 60 that is fluidically connected to the liquid supply units 220. The individual supply flow passages 213*a* and the individual collection flow passages 213*b* described with reference to FIGS. 3A and 3B are formed in the first flow passage member 50. The common supply flow passage 211 and the common collection flow passage 212 described with reference to FIGS. 3A and 3B are formed in the second flow passage member 60. The second flow passage member 60 is joined to the print head support portions 80 and ensures the rigidity of the print head 3 in cooperation with the print head support portions 80. The material of the second flow passage member 60 is preferably a material having sufficient corrosion resistance against the liquid as well as high mechanical strength. To be more precise, SUS, Ti, alumina, and the like can be suitably used as this material.

The cover member 130 is a member that has a frame-like surfaces provided with an elongate cover opening 131. The printing element substrates 10 and sealing members 110 (see FIG. 9) each provided for sealing a connecting portion between each printing element substrate 10 and the flexible wiring substrate 40 are exposed from the cover opening 131 of the cover member 130. A frame portion around the cover opening 131 functions as a contact surface in the case where a cap provided to the printing apparatus 1000 caps the ejection port surface of the print head 3. In order to define an appropriate closed space at the time of capping, it is preferable to coat an adhesive, a sealing member, a filler, or the like around the cover opening 131 so as to bury irregularities and gaps on an ejection port surface of the ejection unit 300.

To assemble the print head 3, the ejection unit 300 is fitted to lower surfaces of the print head support portions 80, then the two electric wiring boards 90 are fitted to the side surfaces on the two sides of print head support portions 80, and then the liquid supply units 220 are attached into the print head support portions 80. Here, a joint rubber member 100 for avoiding a leakage of the ink is located at a connecting portion between each liquid supply unit 220 and the ejection unit 300.

Figure 6:
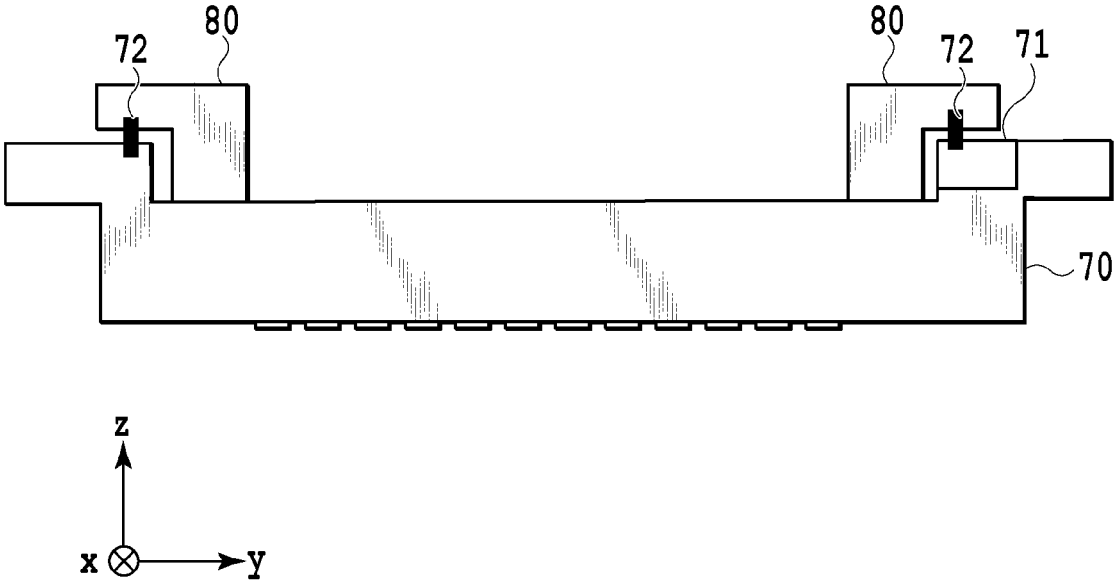
FIG. 6 is a diagram showing a state where the print head is attached to a carriage.

FIG. 6 is a diagram showing a state where the print head 3 is attached to a carriage 70 provided to the printing apparatus 1000. The carriage 70 has a boxed shape so as to be able to load the print head 3, and a movable portion 71 that is slidable in the y direction being the longitudinal direction is provided at one side in the y direction.

In the present embodiment, by providing the movable portion 71 on one side of the carriage 70 as described above, the movable portion 71 of the carriage 70 is allowed to move in the +y direction in case of expansion of the print head 3 in the longitudinal direction. Accordingly, even if the print head 3 is thermally expanded in the longitudinal direction, the carriage 70 can support the print head 3 without causing distortion thereof.

Figure 7A:
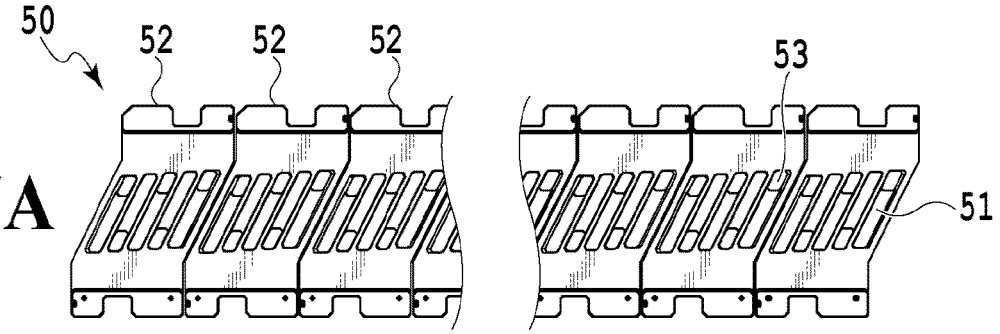
FIGS. 7A to 7E are diagrams for explaining a detailed configuration of a flow passage member.
Figure 7B:
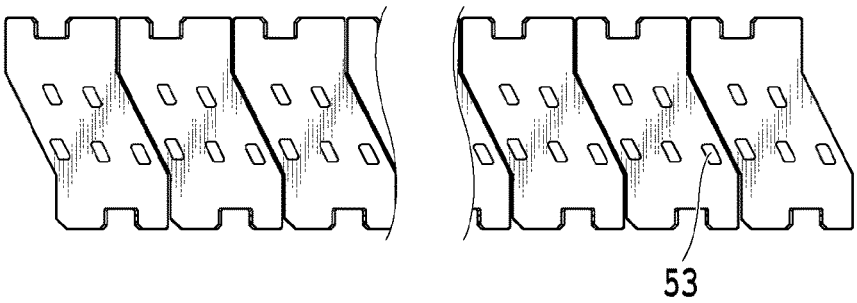
Figure 7C:
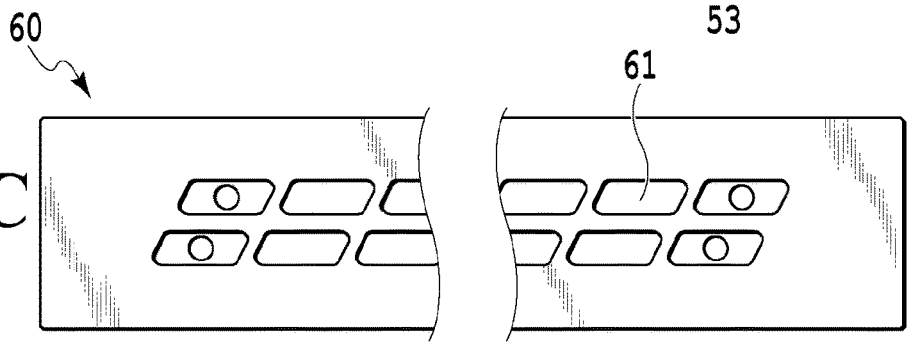
Figure 7D:
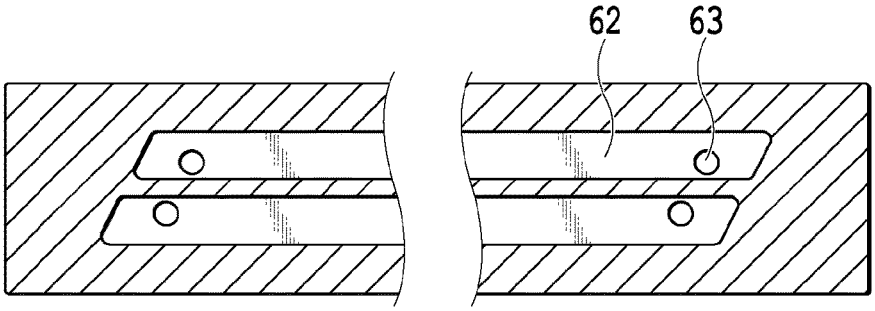
Figure 7E:
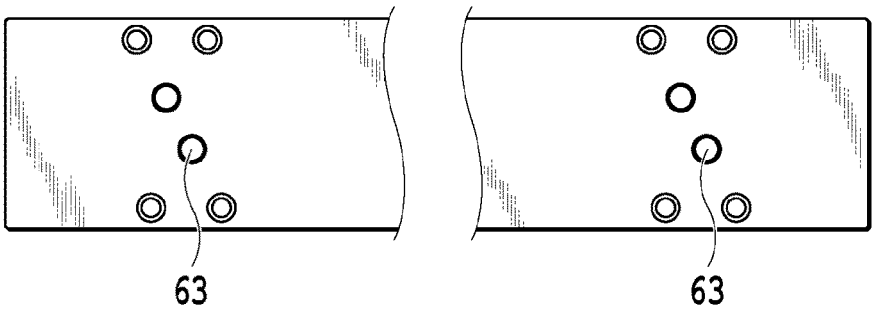

FIGS. 7A to 7E are diagrams for explaining a detailed configuration of the flow passage member 210. FIGS. 7A and 7B show an upper surface and a lower surface of the first flow passage member 50 while FIGS. 7C to 7E show an upper surface, a cross-section of an intermediate layer, and a lower surface of the second flow passage member 60, respectively. FIG. 7A shows the surface that comes into contact with the printing element substrate 10 while FIG. 7E shows the surface that comes into contact with the liquid supply unit 220. Meanwhile, the surface of the first flow passage member 50 shown in FIG. 7B and the surface of the second flow passage member 60 shown in FIG. 7C come into contact with each other.

The first flow passage member 50 includes individual members 52 that are arranged in the y direction. Each individual member 52 corresponds to one of the printing element substrates 10. This configuration makes it possible to assemble the print heads 3 in various sizes by adjusting the numbers of the arranged ejection modules 200 and the arranged individual members 52.

As shown in FIG. 7A, communication passages 51 which are fluidically connected to the printing element substrates 10 to form the individual supply flow passages 213*a* and the individual collection flow passages 213*b* described with reference to FIGS. 3A and 3B are formed in the surface of the first flow passage member 50 to come into contact with the printing element substrates 10. Each communication passage 51 is provided with an individual communication port 53, which fluidically communicates with the second flow passage member 60.

As shown in FIG. 7C, communication ports 61 that communicate with individual communication ports 53 in the first flow passage member 50 are formed in the surface of the second flow passage member 60 that comes into contact with the first flow passage member 50. A pair of communication ports 61 for supply and collection are provided corresponding to each individual member 52.

As shown in FIG. 7D, common flow passage grooves 62 that extend in the y direction and serve as the common supply flow passage 211 and the common collection flow passage 212 described with reference to FIGS. 3A and 3B, respectively, are formed in the intermediate layer of the second flow passage member 60. Common communication ports 63 that fluidically communicate with the liquid supply unit 220 are formed at two end portions of each of the common flow passage grooves 62.

Figure 8A:
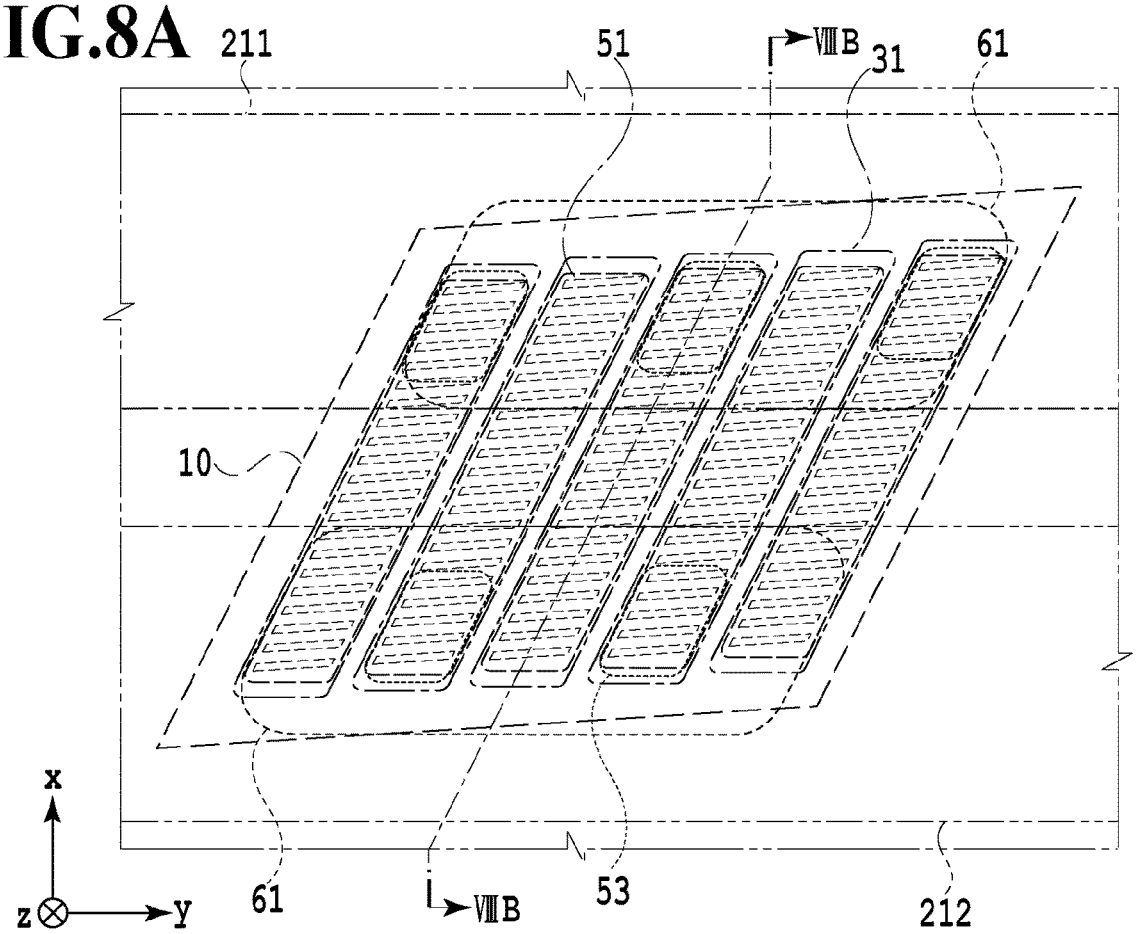
FIG. 8A is a perspective view and FIG. 8B is a cross-sectional view for explaining a flow passage structure formed in the flow passage member.
Figure 8B:
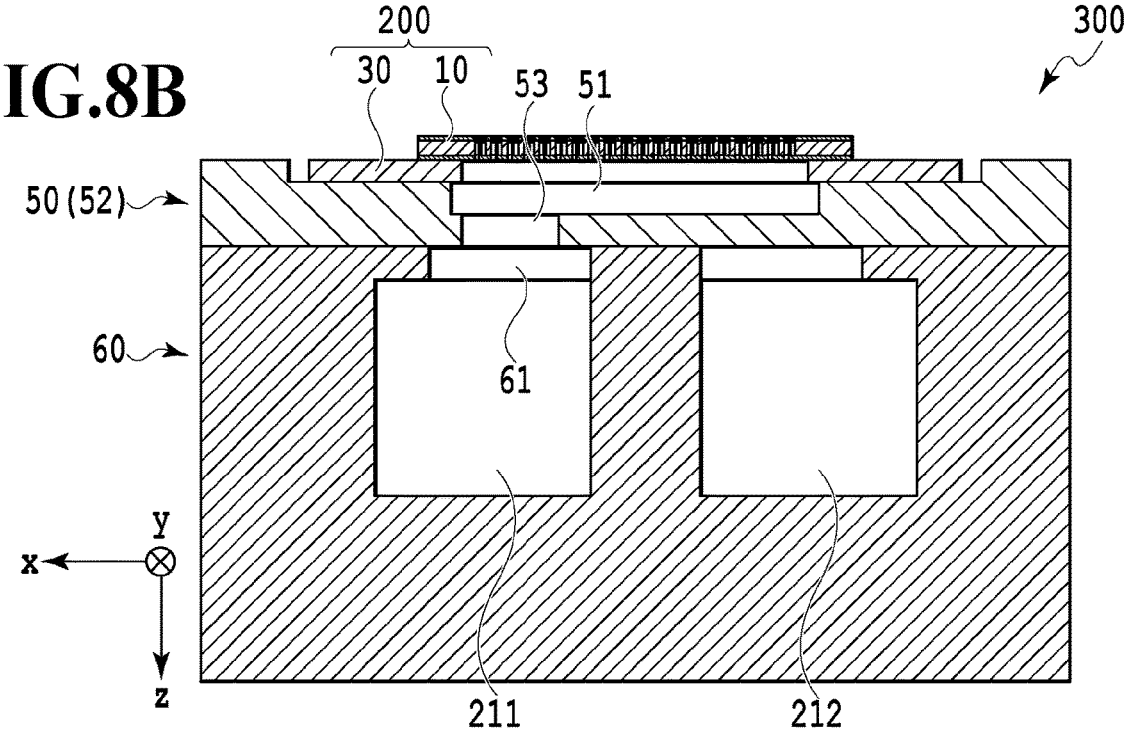

FIG. 8A is a perspective view and FIG. 8B is a cross-sectional view for explaining a flow passage structure formed inside the flow passage member 210. FIG. 8A is an enlarged perspective view that views the flow passage member 210 from the z direction, and FIG. 8B is a cross-sectional view taken along the VIIIB-VIIIB line in FIG. 8A.

The common supply flow passage 211 and the common collection flow passage 212 that extend in the longitudinal direction (the y direction) of the second flow passage member 60 are connected to the first flow passage member 50 through the communication ports 61 in the second flow passage member 60 and the individual communication ports 53 in the first flow passage member 50. Specifically, the second flow passage member 60 and the first flow passage member 50 are stacked on each other while aligning positions of the communication ports 61 with positions of the individual communication ports 53. Meanwhile, the printing element substrates 10 of the ejection modules 200 are placed on the communication passages 51 of the first flow passage member 50 through support members 30. Although FIG. 8B does not illustrate the individual communication ports 53 corresponding to the common collection flow passage 212, it is obvious from FIG. 8A that the individual communication ports 53 should be shown in a different cross-section.

As discussed earlier, the common supply flow passage 211 is connected to the first negative pressure control unit 230 that has the relatively high pressure while the common collection flow passage 212 is connected to the second negative pressure control unit 231 that has the relatively low pressure. As a consequence, an ink supply route is formed from the common communication port 63 (see FIGS. 7A to 7E), the common supply flow passage 211, the communication port 61, the individual communication port 53, the communication passage 51 (the individual supply flow passage 213*a*), and the printing element substrate 10. Likewise, an ink collection route is formed from the printing element substrate 10, the communication passage 51 (the individual collection flow passage 213*b*), the individual communication port 53, the communication port 61, the common collection flow passage 212, and the common communication port 63 (see FIGS. 7A to 7E). While the ink is circulated as described above, each printing element substrate 10 carries out the ejecting operation in accordance with the ejection data. Moreover, the ink supplied through the ink supply route, and not consumed by the ejecting operation is collected through the ink collection route.

Figure 9A:
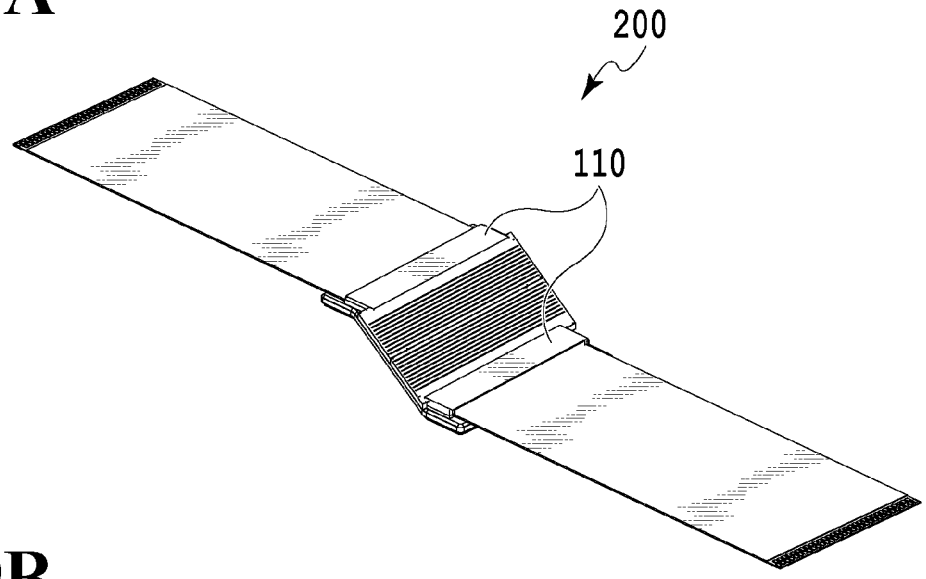
FIG. 9A is a perspective view and FIG. 9B is an exploded diagram of an ejection module.
Figure 9B:
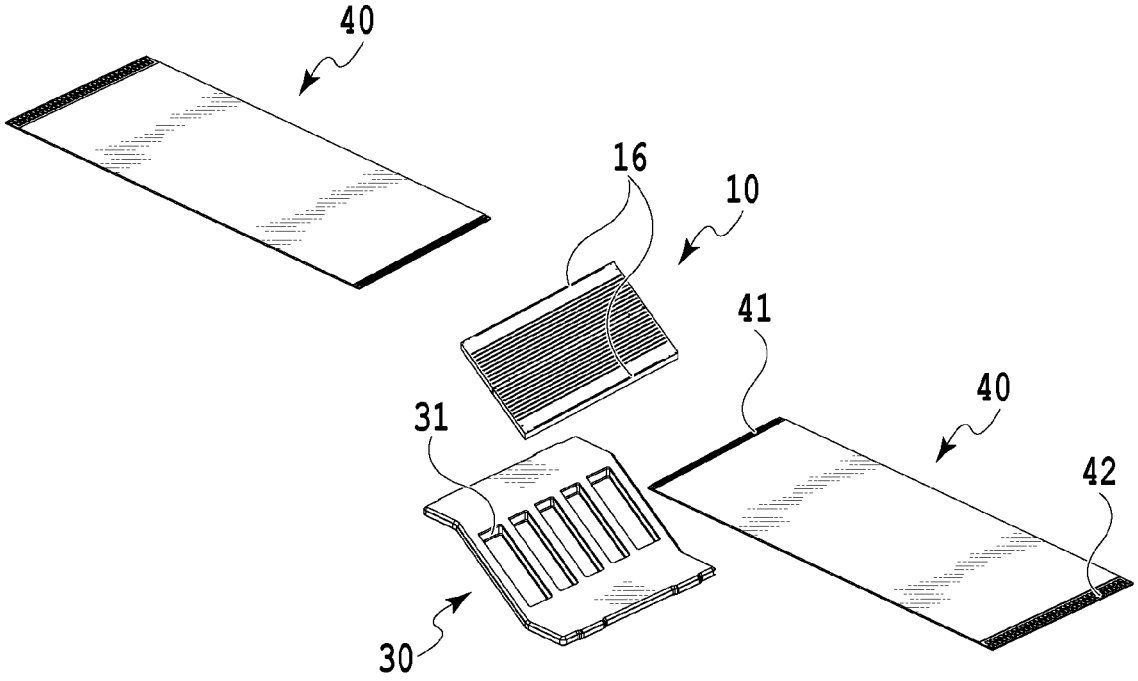

FIG. 9A is a perspective view and FIG. 9B is an exploded diagram of the ejection module 200. The ejection module 200 is manufactured by attaching the printing element substrate 10 to the support member 30, electrically connecting terminals 16 of the printing element substrate 10 to terminals 41 of the flexible wiring substrates 40 by wire bonding, then sealing wire-bonded portions with the sealing members 110. In the flexible wiring substrate 40, a terminal 42 located at a position opposite to the printing element substrate 10 is electrically connected to the electric wiring board 90 (see FIGS. 4A and 4B). The printing element substrate 10 of the present embodiment is provided with twenty rows of the ejection ports, or in other words, twenty rows of the printing elements. Among them, ten rows on one side correspond to one flexible wiring substrate 40 while ten rows on the other side correspond to a different flexible wiring substrate 40. By connecting the flexible wiring substrates 40 on two sides of the printing element substrate 10 as described above, it is possible to set a distance from each row of the printing elements located on the printing element substrate 10 to the corresponding terminal 16 as short as possible, so as to reduce a drop in voltage or a delay in signal transmission which may occur at a wiring portion. Nevertheless, if the number of rows of the printing elements is small or if the drop in voltage or the like does not matter so much, then the flexible wiring substrate 40 may be located only on one side of the printing element substrate 10.

In the support member 30, liquid supply ports 31 serving as openings are formed at positions corresponding to the communication passages 51 described with reference to FIGS. 8A and 8B in such a way as to extend across all the rows of the ejection ports of the printing element substrate 10. The support member 30 serves as a support for the printing element substrate 10 and as a flow passage member located between the printing element substrate 10 and the flow passage member 210 at the same time. Accordingly, the support member 30 preferably has a high degree of flatness and is bondable to the printing element substrate 10 with sufficiently high reliability. Examples of a material suitably used for the support member 30 include alumina, resin materials, and the like.

<Configuration of Printing Element Substrate>

Figure 10A:
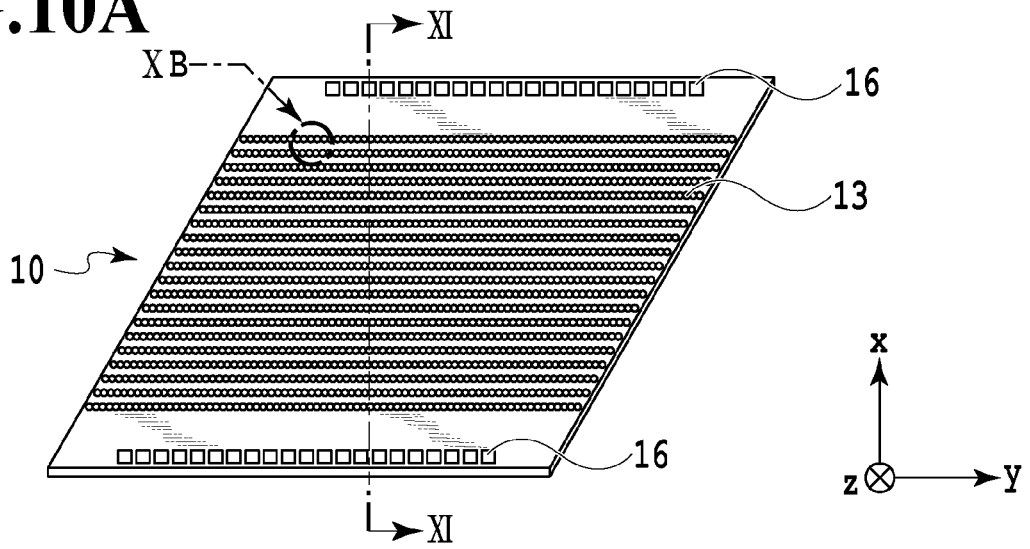
FIGS. 10A to 10C are diagrams for explaining a structure of a printing element substrate in detail.
Figure 10B:
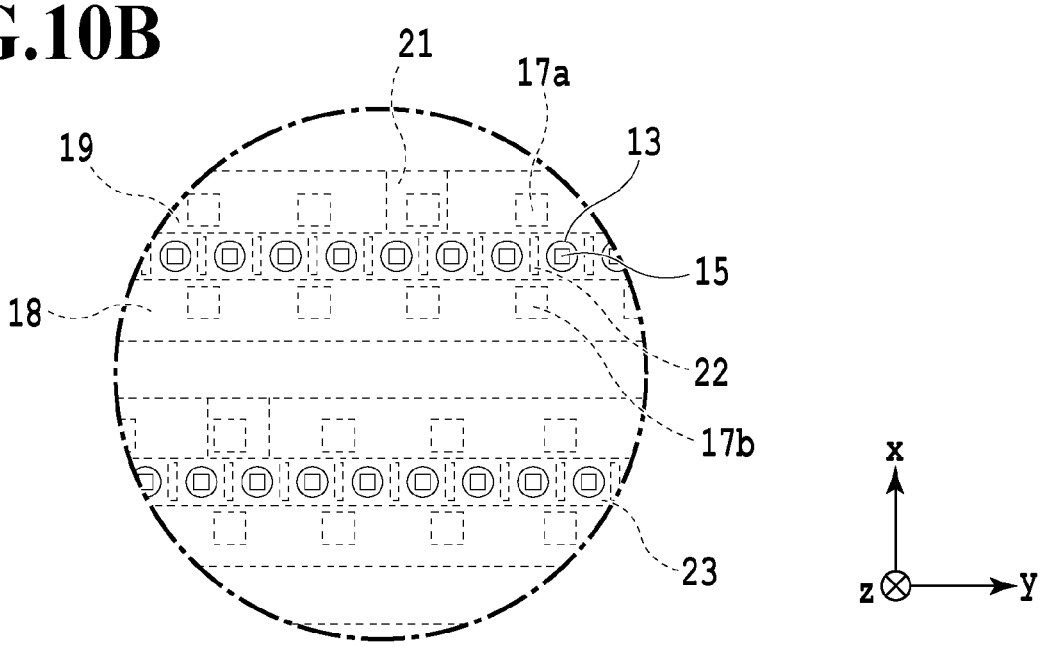
Figure 10C:
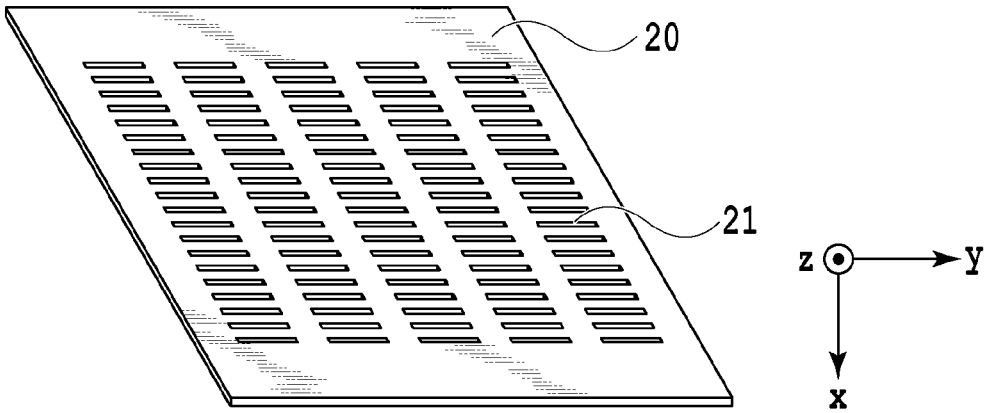
Figure 11:
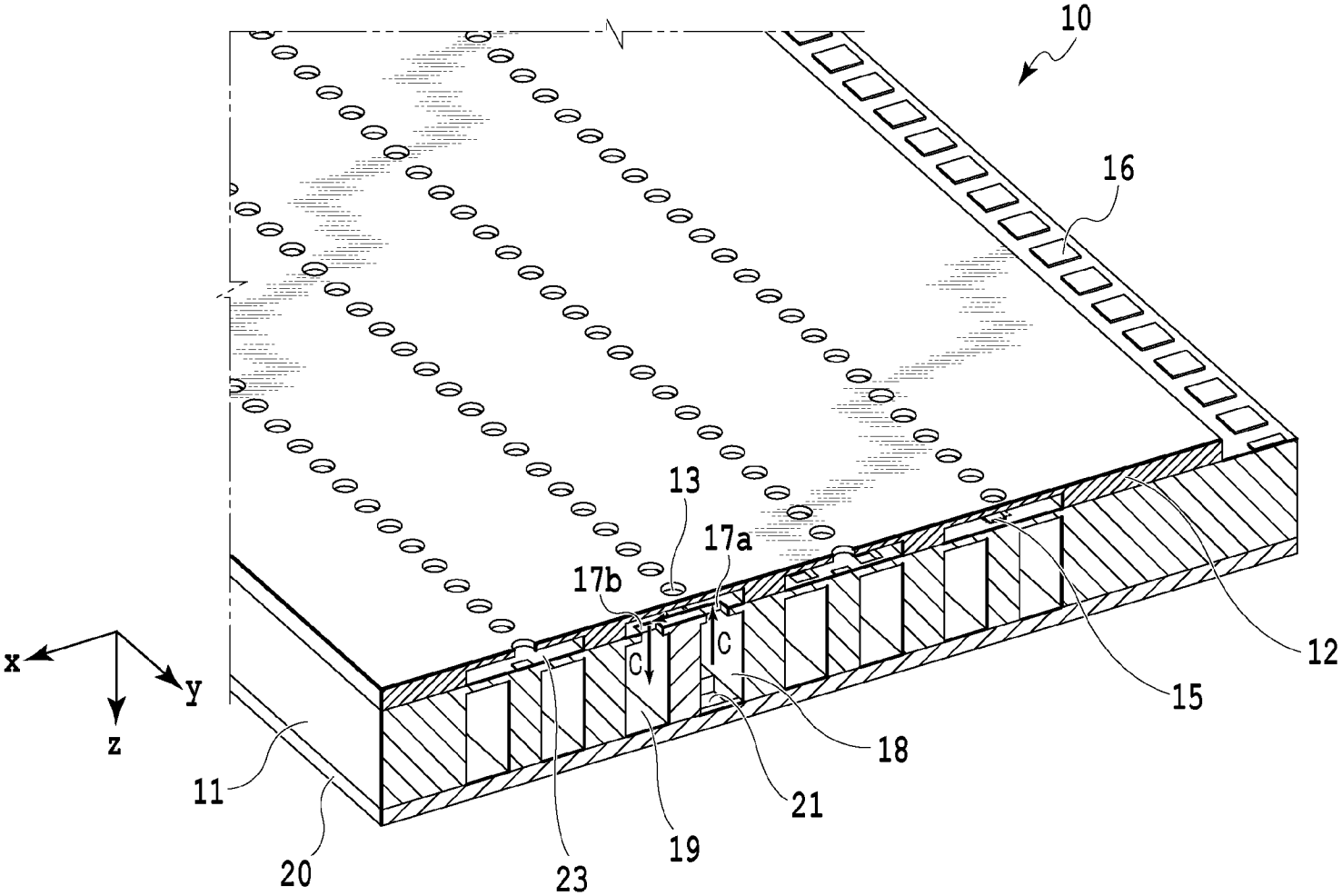
FIG. 11 is a diagram for explaining the structure of the printing element substrate in detail.

FIGS. 10A to 10C and FIG. 11 are diagrams for explaining a structure of the printing element substrate 10 in detail. FIG. 10A is a top plan view of the printing element substrate 10, FIG. 10B is an enlarged perspective view of a region XB indicated in FIG. 10A, and FIG. 10C is a rear view of the printing element substrate 10. Meanwhile, FIG. 11 is a cross-sectional view taken along the XI-XI line in FIG. 10A. As shown in FIG. 11, each printing element substrate 10 is formed by laminating an ejection port forming member 12 made of a photosensitive resin, a board 11 made of silicon, and a thin-film cover plate 20.

As shown in FIG. 10A, the printing element substrate 10 of the present embodiment takes on a parallelogram. Moreover, in the printing element substrate 10, the terminals 16 to be electrically connected to the flexible wiring substrates 40 are formed at two end portions in the lateral direction (the ±x directions) of the print head 3.

Twenty rows of the ejection ports are arranged parallel in the x direction in the ejection port forming member 12. Each row of the ejection ports includes ejection ports 13 that are arranged in the y direction and configured to eject the ink of the same color. Accordingly, the ejection data corresponding to one pixel only needs to be ejected from one of the twenty ejection ports located at the same position in the y direction, so that a drive frequency of the print head 3 can be increased in a state of ensuring a drive cycle of each ejection port. In the meantime, even if one of the ejection ports causes an ejection failure, the ejection data corresponding to the relevant ejection port can be allocated to another ejection port located at the same position in the y direction. In this way, it is possible to print an image without a flaw.

FIG. 10B is the enlarged perspective view of the region XB indicated in FIG. 10A. In the ejection port forming member 12, pressure chambers 23 are formed by arranging partition walls 22 at a predetermined pitch in the y direction so as to define the chambers. Printing elements 15 being electrothermal conversion elements are provided at positions on a surface of the board 11, which correspond to the respective pressure chambers 23. Each printing element 15 is electrically connected to the terminal 16 with not-illustrated wiring provided on the printing element substrate 10. The control unit 500 (see FIG. 2) of the printing apparatus 1000 emits a pulse voltage in accordance with the ejection data, and this pulse voltage is applied to the printing element 15 through the electric wiring board 90 and the flexible wiring substrate 40. Then, the printing element 15 generates the heat to cause film boiling in the liquid stored in the corresponding pressure chamber 23, and growth energy of a bubble thus generated ejects the ink stored in the pressure chamber 23 outward from the ejection port 13.

Meanwhile, liquid supply passages 18 coupled to the individual supply flow passages 213*a* of the flow passage member 210 and connected to the pressure chambers 23 and liquid collection passages 19 coupled to the individual collection flow passages 213*b* of the flow passage member 210 and connected to the pressure chambers 23 extend in the y direction on two sides in the x direction of each row of the ejection ports. Meanwhile, as shown in the cross-sectional view of FIG. 11, supply ports 17*a* to communicate with the pressure chambers 23 are provided to the liquid supply passages 18 and collection ports 17*b* to communicate with the pressure chambers 23 are provided to the liquid collection passages 19 in such a way as to correspond to the pressure chambers 23, respectively. The liquid inside the pressure chambers 23 is circulated between the pressure chambers 23 and the outside through the supply ports 17*a* and the collection ports 17*b*. In other words, the fresh ink is supplied to the pressure chambers 23 irrespective of whether or not the ink is ejected from each of the ejection ports 13 for the ejecting operation.

Moreover, as shown in FIG. 10C, the cover plate 20 located on the side to come into contact with the first flow passage member 50 is provided with openings 21 at positions corresponding to the communication passages 51 in the first flow passage member 50 and to the liquid supply ports 31 in the support member 30. In the present embodiment, the cover plate 20 is provided with three openings 21 for each liquid supply passage 18 and two openings 21 for each liquid collection passage 19. As shown in FIG. 10B, each of the openings 21 in the cover plate 20 communicates with one of the communication passages 51 shown in FIG. 7A. Sufficient corrosion resistance against the liquid (the ink) and high layout accuracy of the openings 21 are required in the above-described cover plate 20. Accordingly, these cover plates 20 are preferably formed in accordance with photolithographic process by using a photosensitive resin material and a silicon plate.

Figure 12:
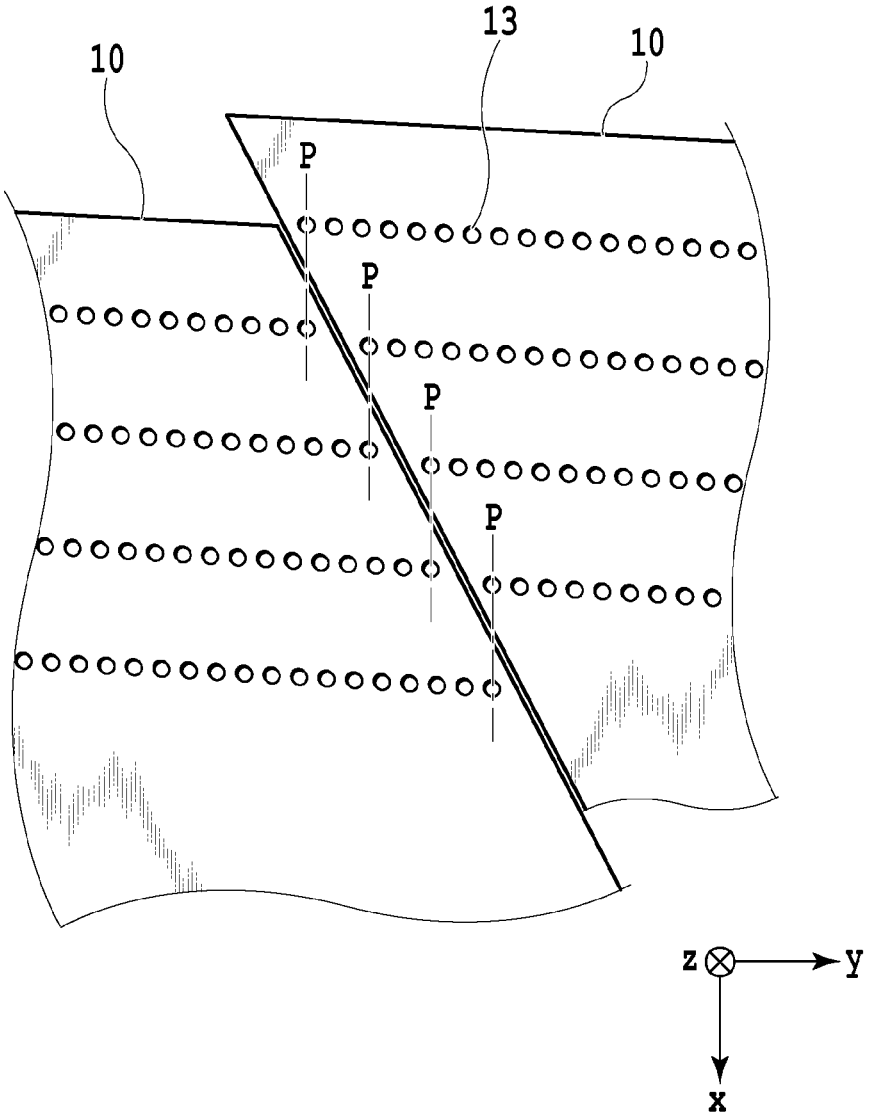
FIG. 12 is a diagram showing a state of connection between the printing element substrates located adjacent to each other.

FIG. 12 is a diagram showing a state of connection between the printing element substrates 10 located adjacent to each other. The print head 3 of the present embodiment takes on the parallelogram and the two printing element substrates 10 located adjacent to each other are continuously placed in the y direction while bringing a lateral side of one of the printing element substrates 10 into contact with a lateral side of the other printing element substrate 10. In this case, the printing element substrates 10 are laid out such that at least one ejection port 13 located on a terminal end of one of the printing element substrates 10 and an ejection port 13 located on a terminal end of the other printing element substrate 10 are situated at the same position in the y direction at a junction of the two printing element substrates 10. In other words, an inclination angle of the parallelogram is designed so as to realize this layout. In FIG. 12, the two ejection ports 13 on a line P are laid out at the same position in the y direction.

According to this configuration, even if the two printing element substrates 10 are connected to each other in a slightly misaligned manner in the course of manufacturing the liquid ejection head, an image at the position corresponding to a connected portion can be printed by using the ejection ports included in such an overlapping region. Hence, it is possible to make a black line or a white line in an image printed on a paper surface due to such misalignment less noticeable. Although a main plane of the printing element substrate 10 is designed as the parallelogram in the above-described example, the present disclosure is not limited only to the foregoing. For example, it is also possible to use printing element substrates having a rectangular, trapezoidal, and other shapes instead.

Although it is not illustrated in FIGS. 10A to 12, each printing element substrate 10 are zoned into multiple areas and the temperature sensor 301 and the sub-heater 302 are provided to each area. Moreover, the control unit 500 (see FIG. 2) carries out temperature adjustment based on the temperature set for each of the areas by using these temperature sensors 301 and sub-heaters 302. Specifically, the control unit 500 drives the sub-heater 302 only for the area where the temperature detected with the temperature sensor 301 falls below a target temperature. By setting the target temperature for the printing element substrate 10 to a relatively high temperature, it is possible to reduce viscosity of the ink and to conduct the ejecting operation and the circulation favorably. Meanwhile, a variation in temperature among the printing element substrates 10 may be controlled within a predetermined range by conducting the temperature control as described above. Thus, it is possible to reduce a variation in amount of ejection attributed to the variation in temperature among the printing element substrates 10 and to suppress unevenness in density in the printed image.

The target temperature for each printing element substrate 10 is preferably set to a temperature that is equal to or above an equilibrium temperature of the printing element substrate 10 in the case of driving all the printing elements 15 at a maximum drive frequency presumable. A diode sensor is applicable to the temperature sensor 301.

Here, the printing elements 15 that are heat generating elements can also be used as heaters for the printing element substrate 10. Specifically, the printing element substrate 10 may be heated by applying a certain voltage to the printing elements 15 which is low enough for avoiding bubble generation. In the present embodiment, the printing elements 15 may be adopted as the heaters instead of the sub-heater 302 or both the sub-heater 302 and the printing elements 15 may be used concurrently.

<Different Example of Print Head>

Figure 13A:
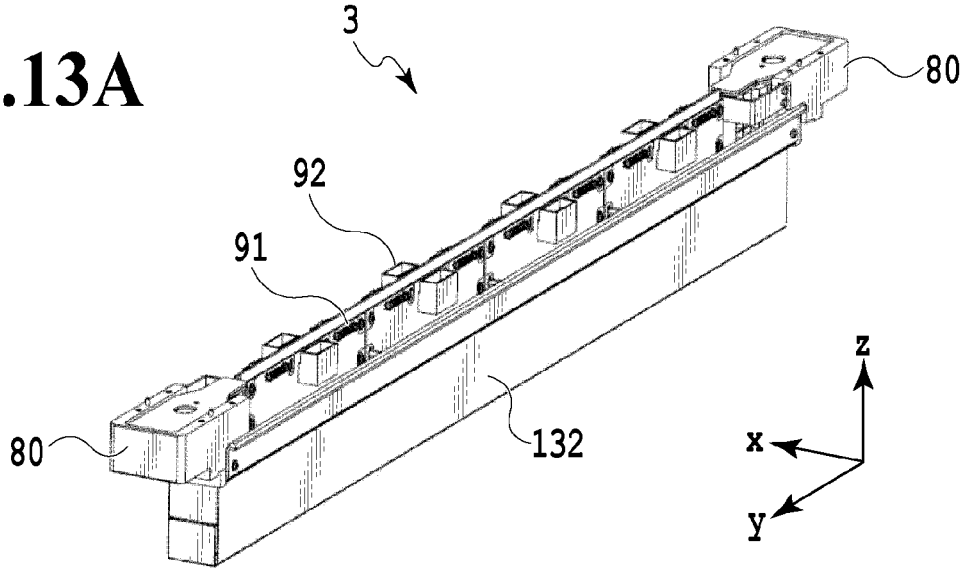
FIGS. 13A and 13B are diagrams for explaining a different example of the print head.
Figure 13B:
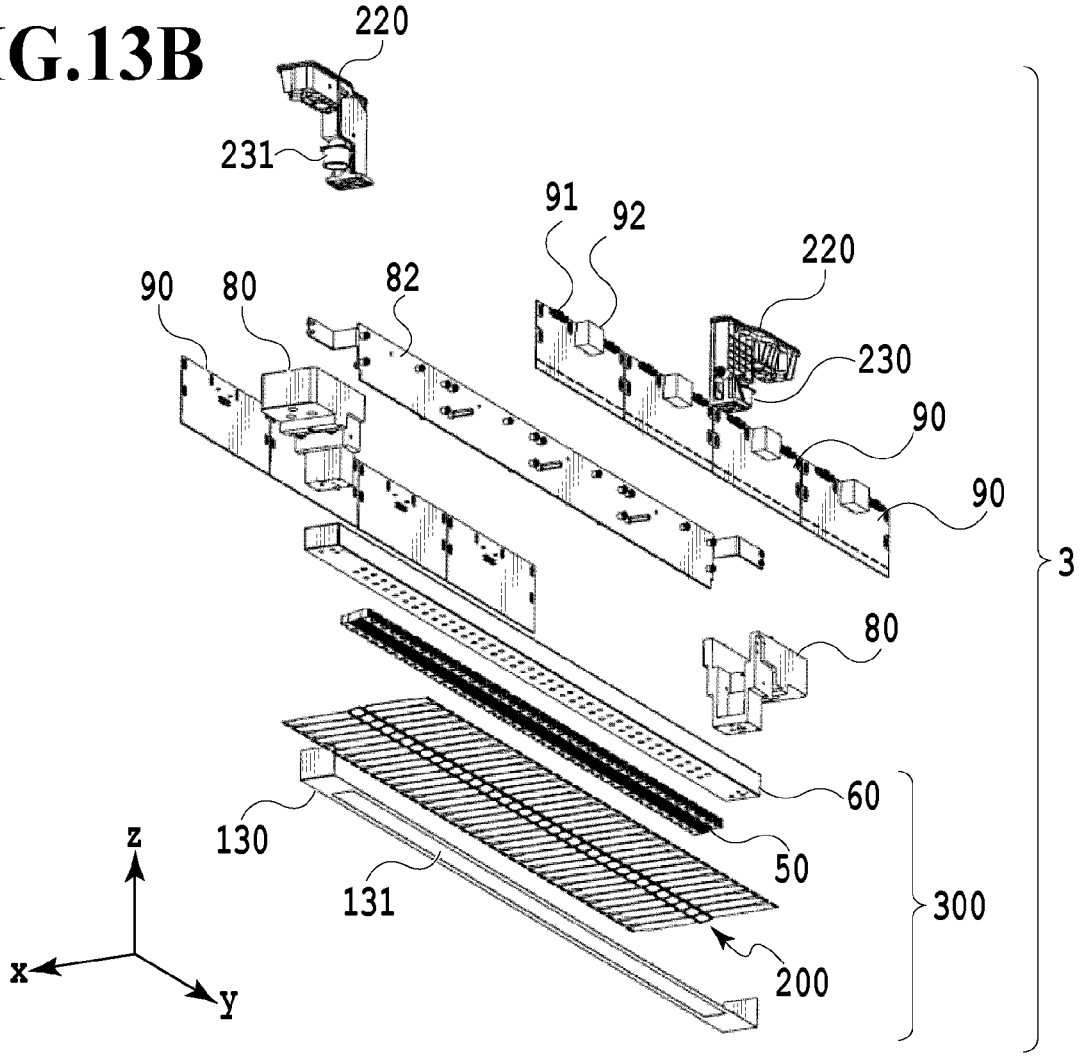

FIGS. 13A and 13B are diagrams for explaining a different example of the print head 3 usable in the present embodiment. FIG. 13A is an external perspective view and FIG. 13B is an exploded diagram of the print head 3. Now, a description will be given below of different features from those of the print head 3 discussed with reference to FIGS. 4A to 5.

In the print head 3 of this example, thirty six ejection modules 200 are arranged in the y direction so that the print head 3 can handle a print medium in a size up to the B2 size (Standard size in Japan). In other words, the print head 3 of this example is even longer than the print head 3 described with reference to FIGS. 4A to 5. Now, different features from those of the print head 3 described with reference to FIGS. 4A to 5 will be explained.

An electric wiring board support portion 82 extending in the y direction is provided at the center in the ±x directions of the print head 3 of this example. Moreover, four electric wiring boards 90 are each arranged in the y direction in a continuous manner on two sides in the ±x directions of the electric wiring board support portion 82, respectively, and are supported by the electric wiring board support portion 82. Each electric wiring board 90 is provided with the signal input terminal 91 and the power supply terminal 92. Shield plates 132 are provided on outer sides in the ±x directions of the electric wiring boards 90 so as to protect wiring circuits on the electric wiring boards 90, the flexible wiring substrates 40, and the connecting portions thereof. Note that the illustration of the shield plates 132 is omitted in the exploded diagram of FIG. 13B.

In the print head 3 of this example, the first negative pressure control unit 230 and the second negative pressure control unit 231 are provided on a lower side (the −z direction side) of the liquid supply unit 220, which do not project upward from the respective print head support portions 80.

Figure 14A:
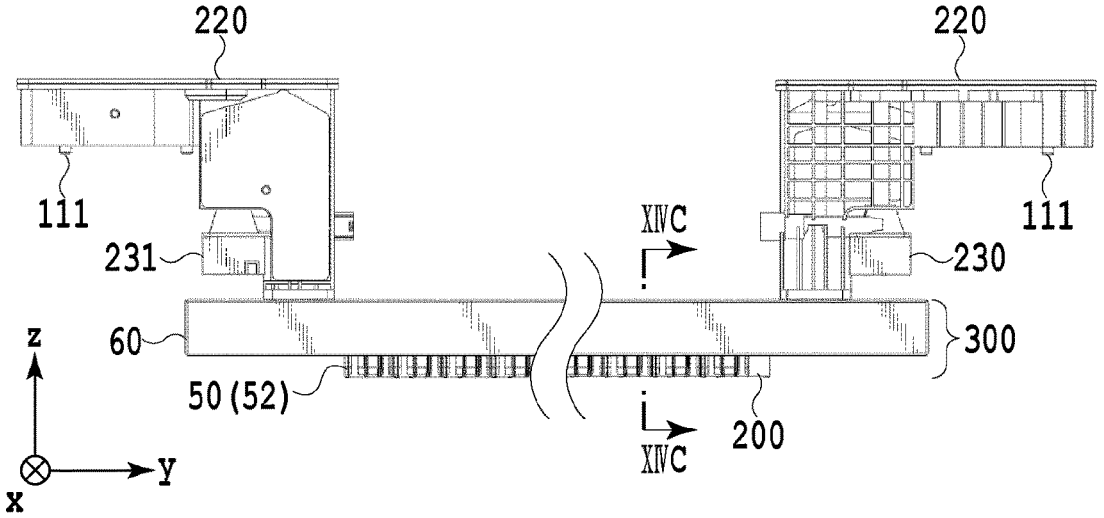
FIGS. 14A to 14C are diagrams showing a flow passage structure of the print head of the different example in detail.
Figure 14B:
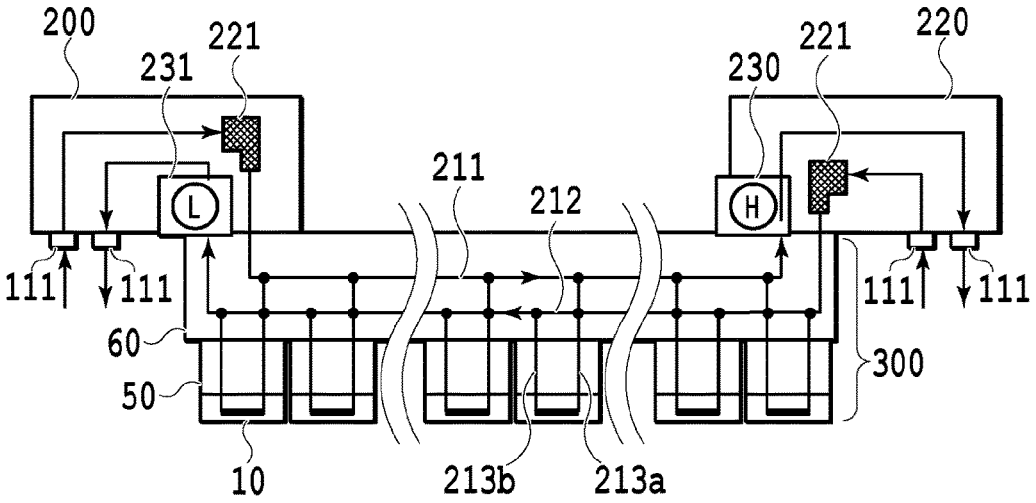
Figure 14C:
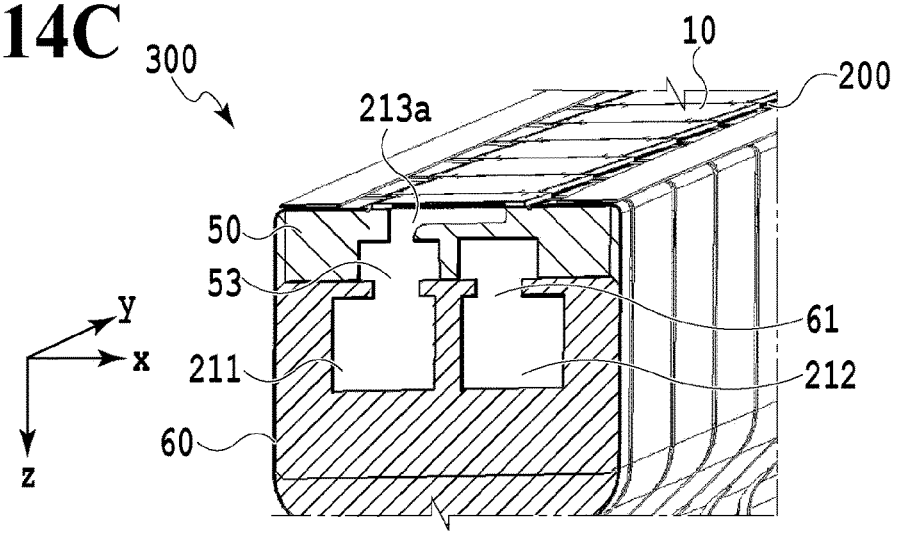

FIGS. 14A to 14C are diagrams showing a detailed flow passage structure of the print head 3 of this example. FIG. 14A is a sectional side view of the print head 3. As compared to the configuration described with reference to FIGS. 4A and 4B, a distance in a direction of gravitational force (the z direction) from each of the first negative pressure control unit 230 and the second negative pressure control unit 231 to the printing element substrates 10 is shorter in this example. For this reason, the number of flow passage connecting portions is smaller than that in the configuration described with reference to FIGS. 4A and 4B. Accordingly, it is possible to reduce the number of components and the number of assembling processes, and to suppress ink leakages.

In the meantime, the water head difference of the first negative pressure control unit 230 and the second negative pressure control unit 231 from the ejection module 200 becomes smaller than that in the configuration described with reference to FIGS. 4A and 4B. Accordingly, this structure is favorably applicable in particular to the mode of the printing apparatus 1000 shown in FIG. 1B, namely, the mode in which the print heads are arranged at various inclination angles. Moreover, the smaller water head difference reduces flow resistance in circulation flow passages and diminishes a difference in pressure loss associated with a change in flow rate, thus enabling stable negative pressure control.

FIG. 14B is a schematic diagram showing an aspect of the ink circulation in the print head 3 of this example. The ink circulation in this example is basically equivalent to the circulation described with reference to FIG. 3B. That is to say, the pressure of the ink flowing in the ejection unit 300 is controlled by the first negative pressure control unit 230 and the second negative pressure control unit 231, which function as the back pressure regulators that are located on the downstream of the ejection unit 300.

FIG. 14C is a cross-sectional view taken along the XIVC-XIVC line in FIG. 14A. As with the ejection unit 300 described with reference to FIG. 8B, the second flow passage member 60, the first flow passage member 50, and the ejection module 200 are stacked in this order in the ejection unit 300 of this example. However, in the ejection unit 300 shown in FIG. 8B, the support members 30 are interposed between the first flow passage member 50 and the printing element substrates 10. On the other hand, in the ejection unit 300 of this example, the cover plate 20 (see FIG. 11) for the printing element substrates 10 is directly placed on the surface of the first flow passage member 50.

The individual supply flow passages 213*a* and the individual collection flow passages 213*b* provided to the respective individual members 52 constituting the first flow passage member 50 communicate with the openings 21 (see FIG. 10C) in the cover plate 20 provided on rear surfaces of the printing element substrates 10. In the ejection unit 300 of this example, each individual communication port 53 in the first flow passage member 50 is the opening which is sufficiently larger than the communication port 61 in the second flow passage member 60. For this reason, it is easier to conduct positioning in the case of mounting the first flow passage member 50 on the second flow passage member 60 than the configuration described with reference to FIGS. 4A to 8B. As a consequence, it is possible to improve a yield in manufacturing the print heads.

Both of the print head described with reference to FIGS. 4A to 8B and the print head 3 described with reference to FIGS. 13A to 14C can be favorably used in the printing apparatus 1000 of the present embodiment.

<Misalignment of Printing Positions Associated with Heat Deformation of Print Head>

Figure 15A:
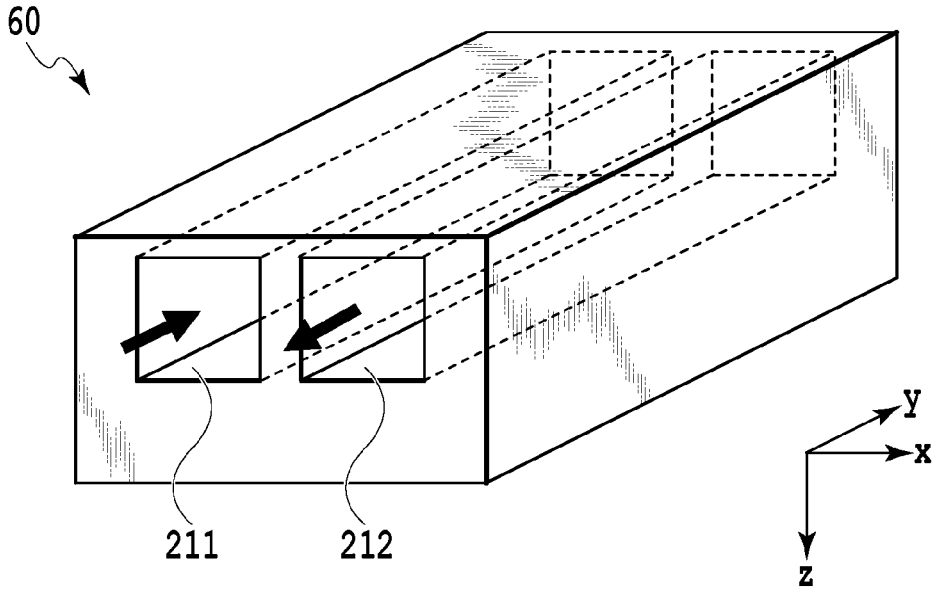
FIGS. 15A and 15B are diagrams for explaining heat deformation of the print head.
Figure 15B:
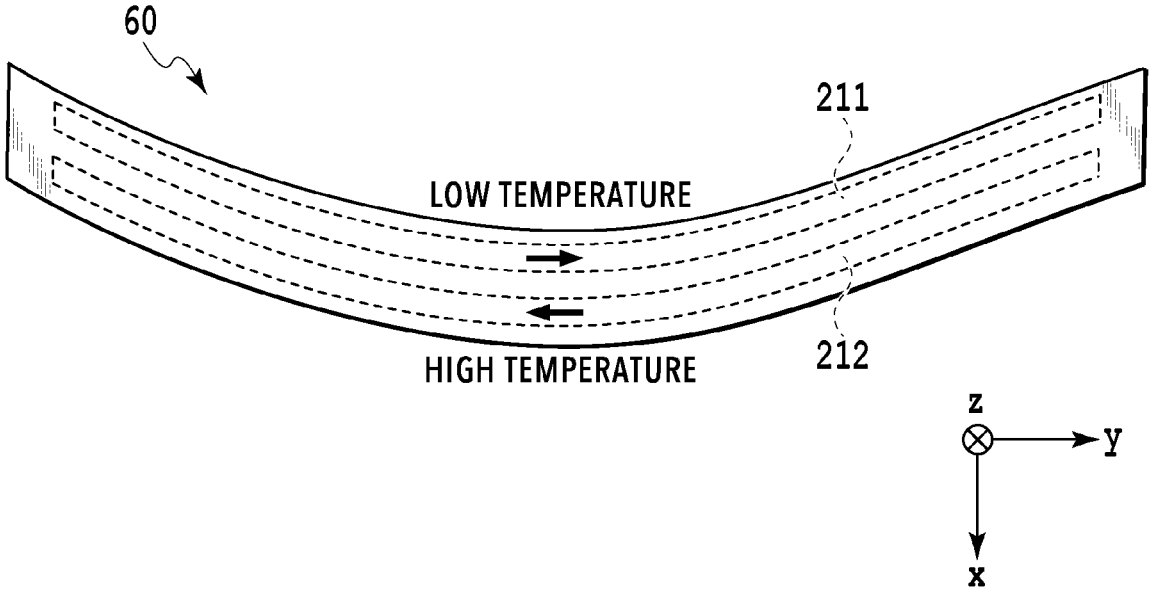

FIGS. 15A and 15B are diagrams for explaining heat deformation of the print head. As described earlier, each printing element substrate 10 in the print head 3 of the present embodiment is provided with the temperature sensors 301 and the sub-heaters 302, and the printing element substrate 10 is adjusted to an appropriate temperature in the course of the printing operation. The above-described processing to adjust the temperature of the print head 3 prior to the printing operation will be hereinafter referred to as temperature adjustment processing.

In the case of conducting the temperature adjustment processing, the ink before being heated by the printing element substrate 10 flows in the common supply flow passage 211 while the ink after being heated by the printing element substrate 10 flows in the common collection flow passage 212. For this reason, the common collection flow passage 212 side of the second flow passage member 60 becomes hotter than the common supply flow passage 211 side thereof and causes larger thermal expansion. Thus, the heat deformation as shown in FIG. 15B develops due to a warpage such that the common collection flow passage 212 side projects in the x direction. Then, this heat deformation grows larger in the case where the heating temperature using the sub-heater 302 is higher or in the case where an amount of circulation of the ink passing through the printing element substrate 10 is larger.

Meanwhile, the temperature sensors 301 and the sub-heaters 302 inevitably have some variations. In the meantime, the amount of circulation of the ink that passes through the printing element substrate 10 depends on a difference in pressure created by the first and second negative pressure control units 230 and 231, flow resistance of the printing element substrate 10, viscosity of the ink, and other factors. Here, it is also difficult to eliminate tolerances or variations of these factors. For this reason, the print heads 3 mounted on the printing apparatus 1000 cause a certain inevitable variation in heat deformation during the temperature adjustment processing and the printing operation.

Figure 16A:
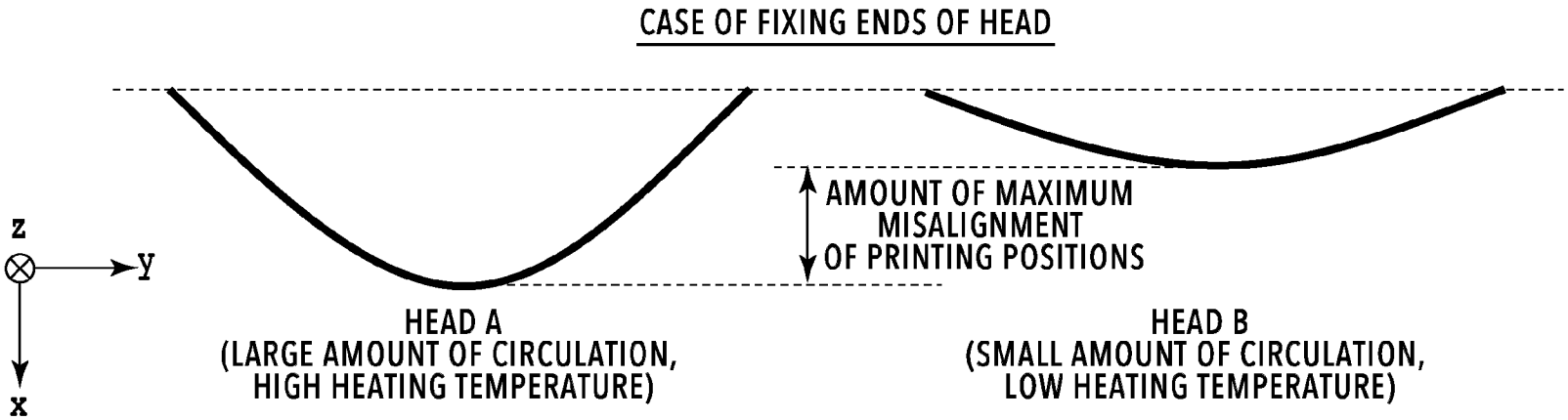
FIGS. 16A and 16B are diagrams for explaining misalignment of printing positions associated with the heat deformation of the print head.
Figure 16B:
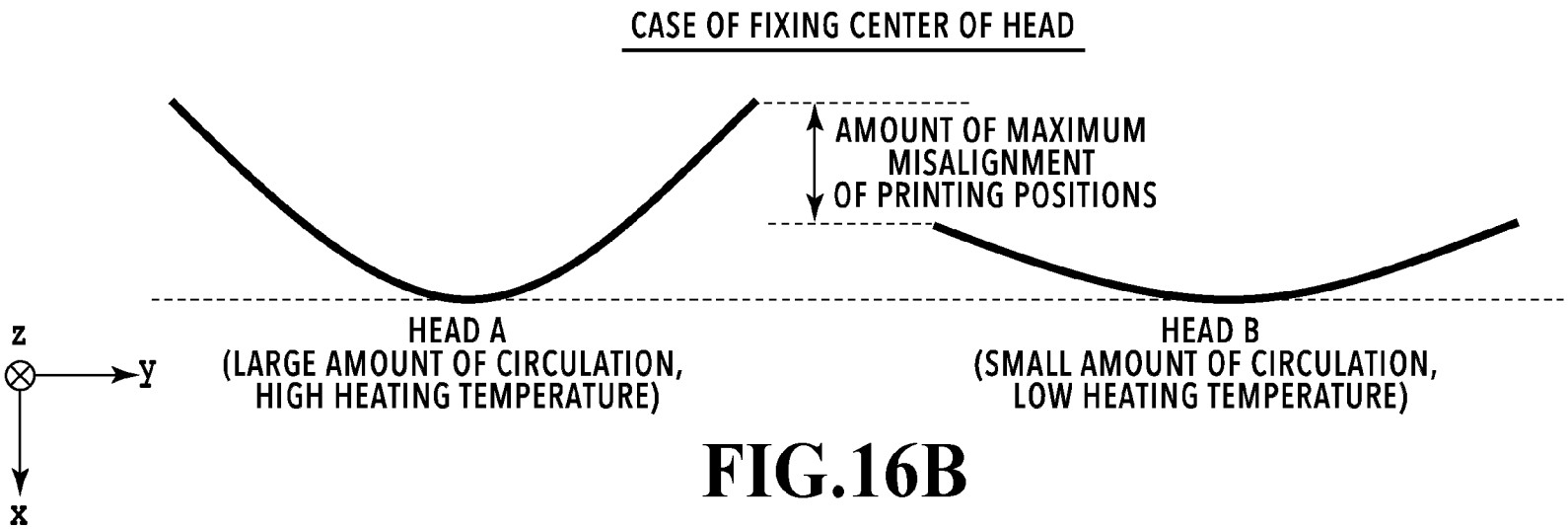

FIGS. 16A and 16B are diagrams for explaining misalignment of the printing positions associated with the heat deformation of the print heads 3. FIG. 16A shows misalignment of the printing positions in the case where two end portions of each print head are fixed to the printing apparatus, while FIG. 16B shows misalignment of the printing positions in the case where a central portion of each print head is fixed to the printing apparatus. In each of FIGS. 16A and 16B, the left side shows a ruled line printed with a head A that causes relatively large heat deformation while the right side shows a ruled line printed with a head B that causes relatively small heat deformation. The head A is a print head in which the temperature detected by the temperature sensor 301 is lower than the real temperature and the sub-heater 302 is therefore driven a little higher. In another case, the head A is a print head which involves a relatively large amount of circulation of the ink in the printing element substrate 10 due to a large difference in pressure created by the two negative pressure control unit 230 and 231 or lower viscosity of the ink as compared to that in other print heads.

On the other hand, the head B is a print head in which the temperature detected by the temperature sensor 301 is higher than the real temperature and the sub-heater 302 is therefore driven a little lower. In another case, the head B is a print head which involves a relatively small amount of circulation of the ink in the printing element substrate 10 due to a small difference in pressure created by the two negative pressure control units 230 and 231 or higher viscosity of the ink as compared to that in other print heads.

As described above, each of the print heads 3 causes the misalignment of the printing positions in the x direction due to the heat deformation, and a distorted line is printed despite an attempt to print a straight line. Meanwhile, if these print heads print an image in the same area on a print medium, variations in amount of distortion come into being as misalignment of the printing positions in the x direction. In the case of FIG. 16A where the two end portions of the print head are fixed, the misalignment of the printing positions in the x direction reaches the maximum at the central portion of the print head 3. In the case of FIG. 16B where the central portion of the print head is fixed, the misalignment of the printing positions in the x direction reaches the maximum at the two end portions of the print head 3. Such misalignment of the printing portions may reach the order of several hundred micrometers, and is prone to a deterioration in image quality.

Figure 17:
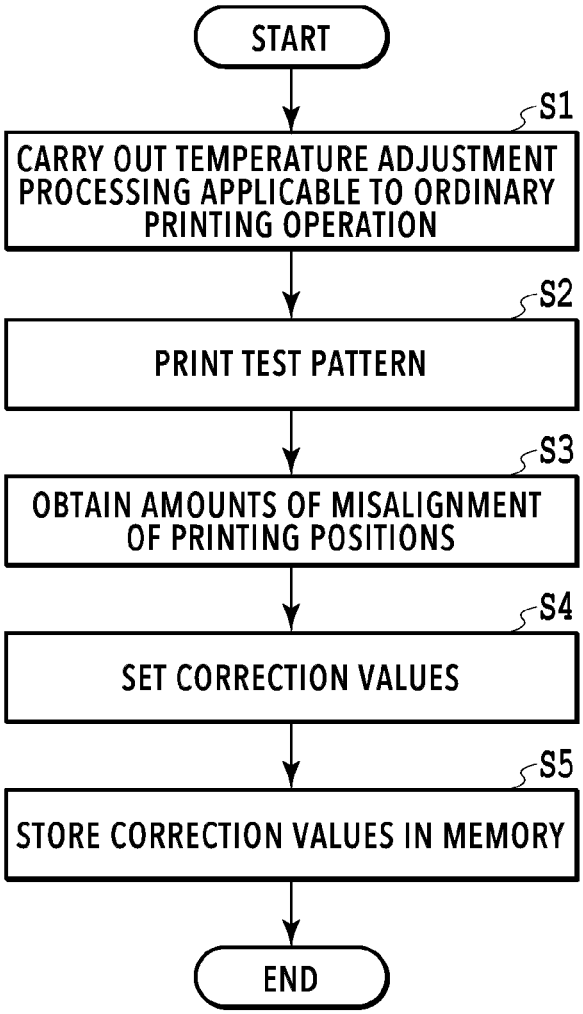
FIG. 17 is a flowchart for explaining correction processing in a first embodiment.

FIG. 17 is a flowchart for explaining processing to correct the misalignment of the printing positions in the present embodiment. This processing is carried out by the control unit 500 in accordance with a program stored in the ROM (see FIG. 2). Meanwhile, in addition to a point of shipment of the printing apparatus 1000, this processing is carried out as appropriate such as in a case of replacement of the print head 3 or in a case where the misalignment of the printing positions of any of the print heads 3 is conspicuous.

In the case where this processing is started, the control unit 500 firstly carries out the temperature control of the print head 3 in step S1 under the same conditions as those at the time of an ordinary printing operation. Then, the control unit 500 stands by until thermal expansion reaches a steady state.

In step S2, the control unit 500 prints a prescribed test pattern on a print medium. The test pattern is not limited to a particular pattern. The test pattern only needs to be capable of checking relative amounts of misalignment in the x direction among the printing element substrates 10.

In step S3, the control unit 500 obtains the amounts of misalignment of the printing positions in the x direction of the respective printing element substrates 10. The amounts of misalignment of the printing positions can be obtained by causing the control unit 500 to read the test pattern while using a not-illustrated reading sensor provided to the apparatus, and then calculating differences in terms of the x direction from a reference position. Alternatively, it is possible to adopt a mode of causing a user or a service person to visually determine a difference between the test pattern outputted in step S2 and a reference pattern and to input a result of determination to the apparatus.

In step S4, the control unit 500 sets a correction value for each printing element substrate 10. This correction value corresponds to a shift amount from a standard value of timing to apply a pulse voltage to the printing element 15. Specifically, if the correction value is $+\Delta t$, then the timing to drive the printing element substrate 10 after the correction is the timing delayed by the value $\Delta t$ from the standard value. On the other hand, if the correction value is $-\Delta t$, then the timing to drive the printing element substrate 10 after the correction is the timing advanced by the value $\Delta t$ from the standard value. This correction value can be calculated based on the amount of displacement of the printing positions obtained in step S3, the velocity of conveyance of the print medium, an ejection speed of the ink, and a distance between the print medium and the ejection port surface.

In step S5, the control unit 500 stores the correction values for the respective printing element substrates 10 set in step S4 into a memory. The memory may be the ROM 501 or a storage unit provided separately from the ROM 501. Hence, this processing is terminated.

The processes in steps S1 to S5 described above are carried out on each of the print heads 3 mounted on the printing apparatus 1000. In this case, the processes from steps S1 to S4 may be carried out on the respective print heads 3 one by one in turn or in parallel at the same time.

Thereafter, in a case where a print command is inputted to the printing apparatus 1000, the control unit 500 reads the correction values for the respective printing element substrates 10 stored in the memory. Then, the image is printed on the print medium according to the image data while controlling the drive timing in accordance with the correction values. In this way, it is possible to print the image on the print medium S while reducing the misalignment of the printing positions.

Figure 18A:
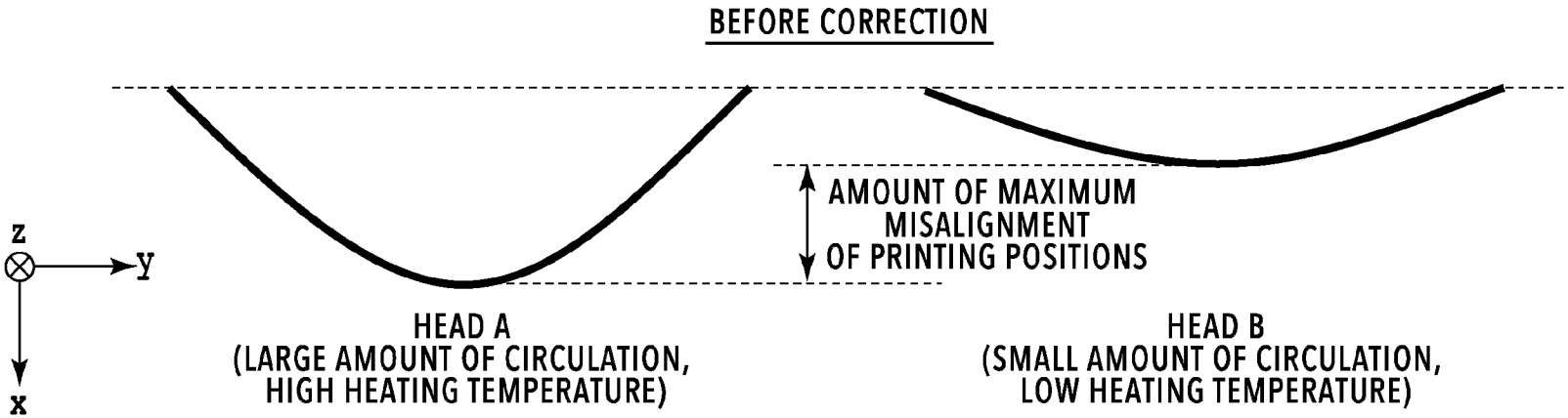
FIGS. 18A and 18B are diagrams for explaining an effect of correction of the misalignment of the printing positions in the first embodiment.
Figure 18B:
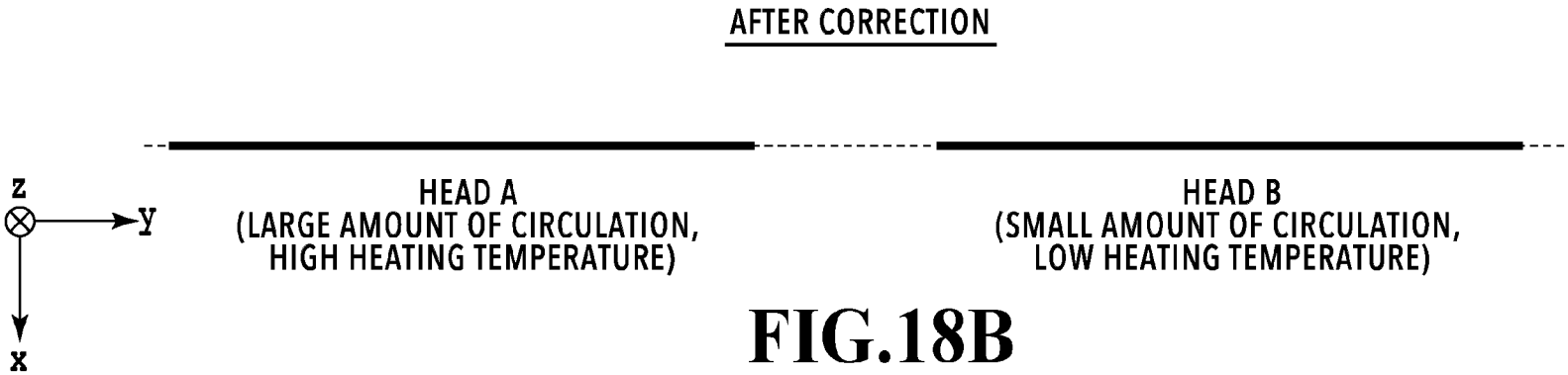

FIGS. 18A and 18B are diagrams for explaining an effect of correction of the misalignment of the printing positions in the present embodiment. FIG. 18A shows a state of printing before carrying out the correction processing. FIG. 18B shows a state of printing after carrying out the correction processing. FIG. 18A is the same drawing as FIG. 16A, which shows the state of printing the ruled line in the state of fixing the two end portions of the print head.

In the case of the head A, the printing position of the central portion is displaced in the +x direction relative to the printing positions at the end portions as shown in FIG. 18A. Accordingly, in the correction processing, the drive timing of the printing element substrates 10 located at the center is corrected in such a way as to be delayed relative to the timing to drive the printing element substrates 10 located at the end portions. In this case, the amount of correction becomes larger as the printing element substrates 10 are located closer to the center or becomes smaller as the printing element substrates 10 are located closer to each end portion. By carrying out the correction processing as described above, the printing positions in the x direction are aligned among all the printing element substrates 10 arranged on the head A, whereby an ideal ruled line that extends in they direction is obtained as shown in FIG. 18B.

The same applies to the head B. However, the amounts of correction for the head B becomes smaller than those for the head A as a whole. Since each of the head A and the head B can print the ideal straight line at the ideal position, the misalignment of the printing positions between the head A and head B is reduced as well.

As described above, according to the correction processing of the present embodiment, it is possible to suppress the misalignment of the printing positions in each print head 3 and the misalignment of the printing positions between the print heads, and thus to print a high-quality image without a color shift.

Second Embodiment

As with the first embodiment, the present embodiment also uses the printing apparatus 1000 and the print head 3 described with reference to FIGS. 1A to 14C. In the present embodiment, however, the correction values for the print heads are set while taking into account a difference in deformation associated with a variation in ejection frequency.

<Difference in Expansion Associated with Variation in Ejection Frequency>

Figure 19:
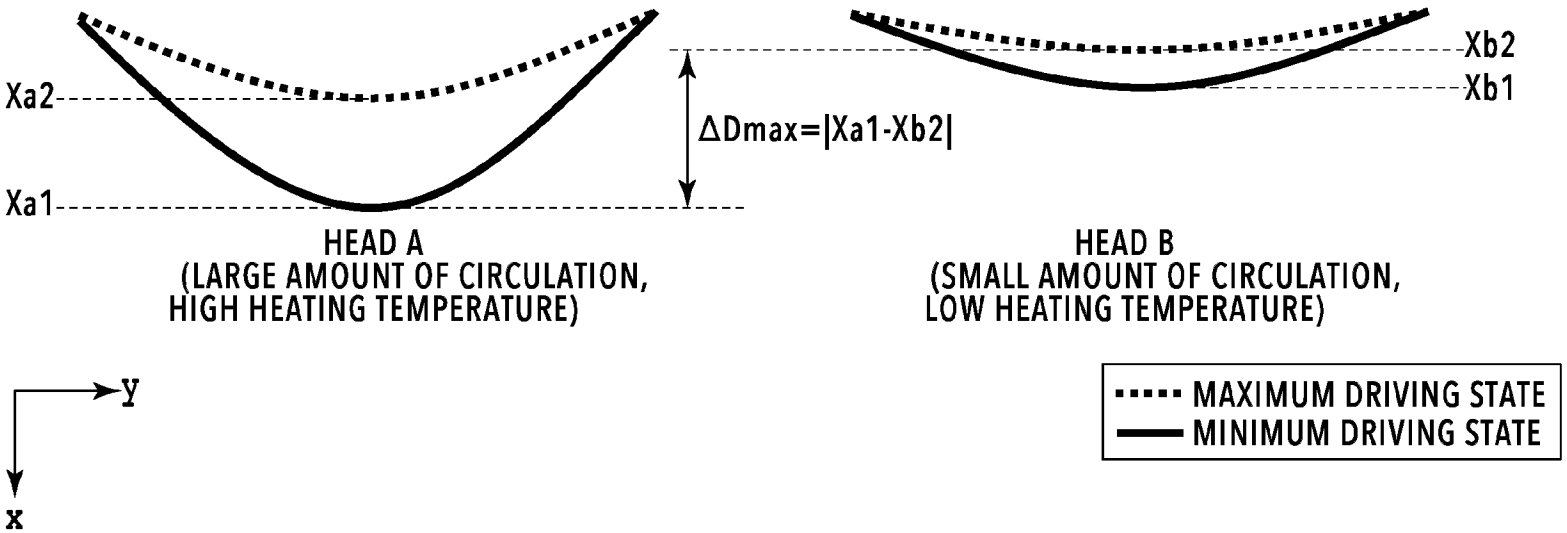
FIG. 19 is a diagram for explaining a difference in deformation of the print head associated with a difference in ejection frequency.

FIG. 19 is a diagram for explaining a difference in deformation of the print head associated with a variation in ejection frequency. Here, a ruled line printed in a maximum driving state and a ruled line printed in a minimum driving state are illustrated so as to be comparable to each other in terms of each of the head A and the head B. In the following description, a state of ejecting a large amount of the ink while driving all the printing elements 15 used for printing at the maximum drive frequency will be referred to as a maximum driving state. Meanwhile, a state of carrying out the ejecting operation at a minimum level that enables a check of the printing positions on the print medium will be referred to as a minimum driving state.

Even in the case of the same print head, an amount of misalignment of the printing positions varies depending on the ejection frequency. The higher the ejection frequency is, the more the heated ink is discharged to the outside whereby the amount of circulation of the ink is decreased. Accordingly, the heat deformation is suppressed and the amount of misalignment in the x direction is reduced as well. Here, at the central portion of the head A, an amount of misalignment in the x direction in the minimum driving state is indicated as Xa1 and an amount of misalignment in the x direction in the maximum driving state is indicated as Xa2. Meanwhile, at the central portion of the head B, an amount of misalignment in the x direction in the minimum driving state is indicated as Xb1 and an amount of misalignment in the x direction in the maximum driving state is indicated as Xb2. Specifically, in the case where the correction processing is not carried out, the central portion of the head A is displaced in a range from the amount Xa1 to the amount Xa2 while the central portion of the head B is displaced in a range from the amount Xb1 to the amount Xb2 during the printing operation. In this case, there occurs a color shift defined as $\Delta Dmax=|Xa1-Xb2|$ at the maximum between the head A that causes the large heat deformation and the head B that causes the small heat deformation. The value $\Delta Dmax$ is an amount of misalignment which is larger than the amount of the maximum misalignment of the printing positions in FIGS. 16A and 16B obtained by the comparison in one driving state.

In the present embodiment, the misalignment of the printing positions of each print head is reduced while also taking into account a difference in expansion associated with the above-described variation in ejection frequency.

Figure 20:
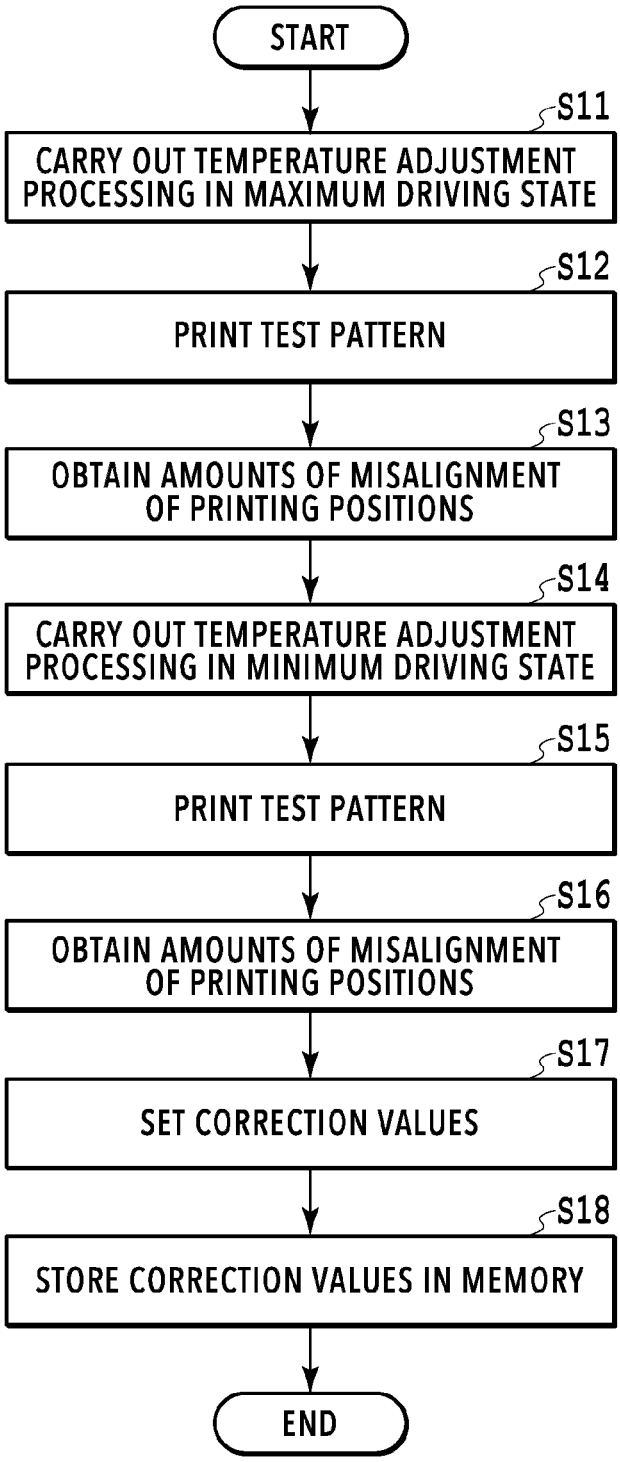
FIG. 20 is a flowchart for explaining the correction processing in a second embodiment.

FIG. 20 is a flowchart for explaining the processing to correct the misalignment of the printing positions in the present embodiment. This processing is carried out by the control unit 500 in accordance with a program stored in the ROM (see FIG. 2). Meanwhile, in addition to the point of shipment of the printing apparatus 1000, this processing is carried out as appropriate such as in the case of replacement of the print head 3 or in the case where the misalignment of the printing positions of any of the print heads 3 is conspicuous.

In the case where this processing is started, the control unit 500 firstly carries out the temperature adjustment processing in step S11 under the maximum driving state. To be more precise, the respective printing element substrates 10 of the print head 3 are heated to an adjustment temperature for an ordinary printing operation, and then all the printing elements are driven at the maximum drive frequency while subjecting to the prescribed circulation control.

The processing proceeds to step S12 after the thermal expansion reaches the steady state. Here, the control unit 500 prints the test pattern read out of the ROM 501 on the print medium.

In step S13, the control unit 500 obtains the amounts of misalignment of the printing positions in the x direction of the respective printing element substrates 10 in the maximum driving state. The method of obtaining the amounts of misalignment of the printing positions is the same as the method according to the first embodiment. Specifically, the amounts of misalignment of the printing positions may be obtained by using the not-illustrated reading sensor provided to the apparatus or by causing the user or the service person to input the result of determination to the apparatus.

In steps S14 to S16, the control unit 500 sets the correction values for the respective printing element substrates 10 in the minimum driving state. Specifically, in step S14, the respective printing element substrates 10 of the print head 3 are heated to the adjustment temperature for the ordinary printing operation first, and are then subjected to the prescribed circulation control without driving the printing elements or while adopting a minimum drive frequency that enables the check of the printing positions on the print medium. Then, as the thermal expansion reaches the steady state, the control unit 500 prints the test pattern on the print medium in step S15. Moreover, in step S16, the control unit 500 obtains the amounts of misalignment of the printing positions in the x direction of the respective printing element substrates 10 in the minimum driving state.

In step S17, the control unit 500 sets the correction values for the respective printing element substrates 10 based on the amounts of misalignment of the printing positions in the maximum driving state obtained in step S13 and the amounts of misalignment of the printing positions in the minimum driving state obtained in step S16.

Figure 21A:
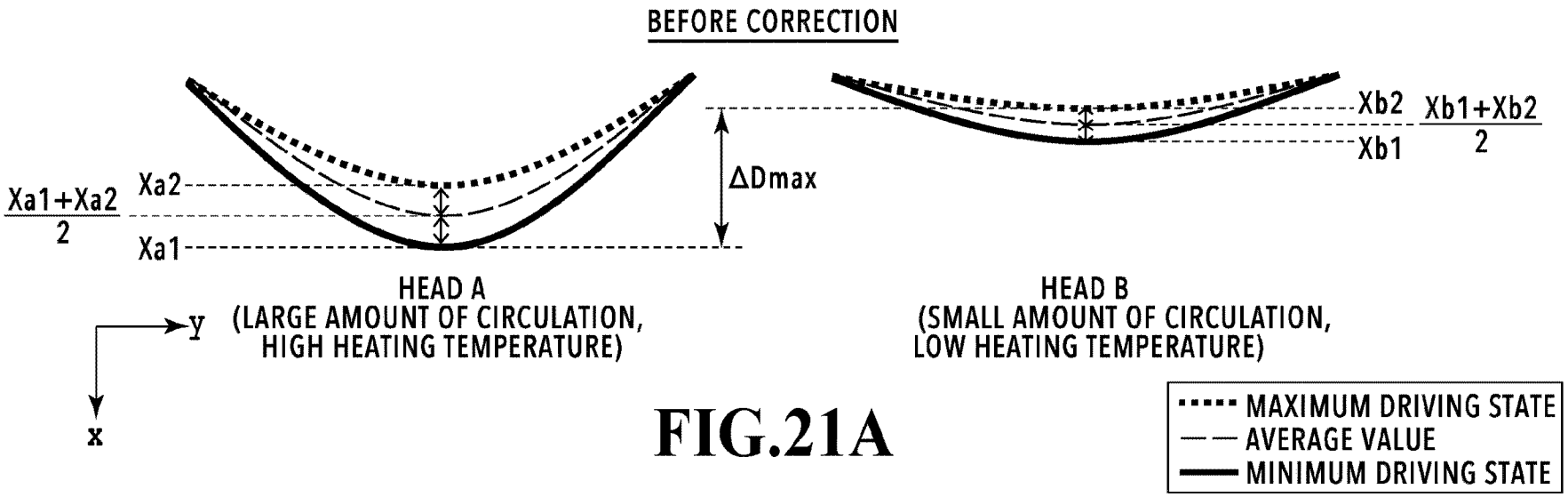
FIGS. 21A and 21B are diagrams for explaining a method of setting a correction value and an effect of the correction in the second embodiment.
Figure 21B:
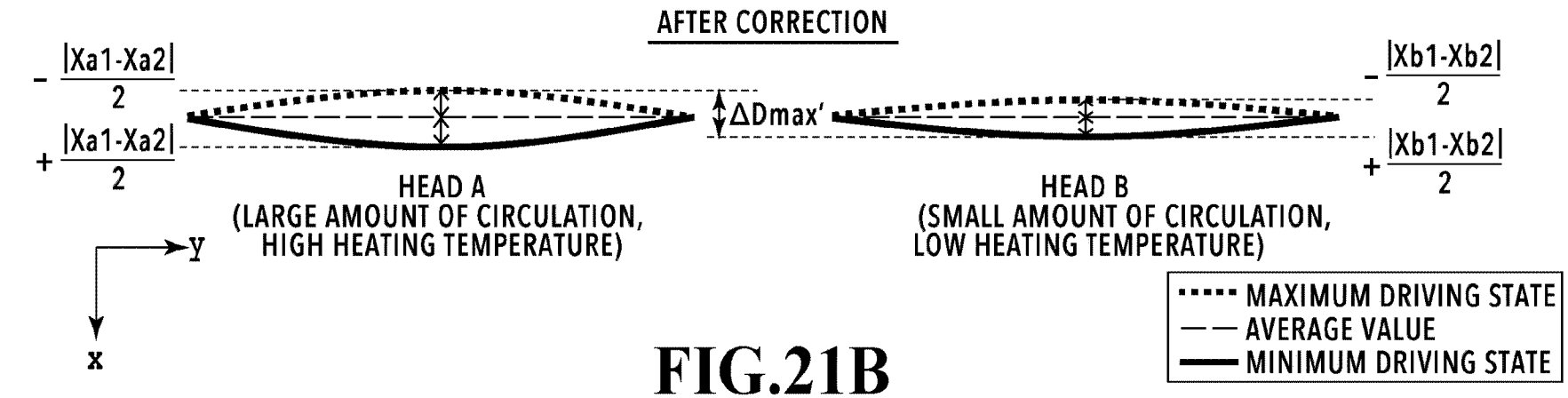

FIGS. 21A and 21B are diagrams for explaining the method of setting the correction value performed by the control unit 500 in step S17 of the present embodiment and an effect of the correction. In the present embodiment, as shown in FIG. 21A, an average value between the misalignment of the printing positions in the maximum driving state and the misalignment of the printing positions in the minimum driving state is obtained for each of the printing element substrates 10. Then, the correction value for adjusting the average amount of misalignment to 0 is set as the correction value for the relevant printing element substrate. For example, the average amount of misalignment is expressed by $(Xa1+Xa2)/2$ at the center of the head A. Hence, the correction value is set in order to adjust this misalignment to 0. The average amount of misalignment is expressed by $(Xb1+Xb2)/2$ at the center of the head B. Hence, the correction value is set in order to adjust this misalignment to 0.

Back to the description of the flowchart of FIG. 20, the control unit 500 stores the correction values for the respective printing element substrates 10 set in step S17 into a memory in step S18. The memory may be the ROM 501 or a storage unit provided separately from the ROM 501. Hence, this processing is terminated.

The respective processes in the correction processing described with reference to the flowchart of FIG. 20 are carried out on each of the print heads 3 mounted on the printing apparatus. In this case, the respective processes may be carried out on the respective print heads 3 one by one in turn or in parallel at the same time.

Thereafter, in the case where the print command is inputted to the printing apparatus 1000, the control unit 500 reads the correction values for the respective printing element substrates 10 stored in the memory. Then, the image is printed on the print medium according to the image data while controlling the drive timing in accordance with the correction values.

FIG. 21B shows a state of printing the ruled lines in accordance with the set correction values. The correction to be carried out on each of the printing element substrates 10 is the correction for adjusting the average amount of misalignment between the amount of misalignment in the maximum driving state and the amount of misalignment in the minimum driving state equal to 0. Accordingly, the correction tends to be a little insufficient in the minimum driving state and the ruled line being warped a little toward the +x side is printed. Meanwhile, the correction tends to be a little excessive in the maximum driving state and the ruled line being warped a little toward the −x side is printed. In the meantime, a substantially straight line is printed in a driving state in the middle of the maximum driving state and the minimum driving state.

To be more precise, according to the correction processing of the present embodiment, the misalignment of the printing positions relative to an ideal position falls within a range of $\pm|Xa1-Xa2|/2$ in the case of the head A and falls within a range of $\pm|Xb1-Xb2|/2$ in the case of the head B. This means that a maximum width of misalignment from the ideal printing position is reduced to a half as compared to that in the first embodiment where the variation in ejection frequency is not taken into account. Moreover, a maximum value $\Delta Dmax'$ of the misalignment of the printing positions between the head A and the head B can also be reduced as compared to the value $\Delta Dmax$.

As described above, according to the correction processing of the present embodiment, it is possible to suppress the misalignment of the printing positions in each print head and the misalignment of the printing positions between the print heads irrespective of the ejection frequency of each print head, and thus to print a high-quality image without a color shift.

In the above description, the average value between the misalignment of the printing positions in the maximum driving state and the misalignment of the printing positions in the minimum driving state is defined as an amount of misalignment targeted for the correction (hereinafter referred to as a correction target misalignment amount). However, the correction target misalignment amount does not have to be the average value. The correction target misalignment amount may be obtained by multiplying each of the misalignment of the printing positions in the maximum driving state and the misalignment of the printing positions in the minimum driving state by an arbitrary weight coefficient. For example, regarding the ink color such as yellow of which dots are rather inconspicuous in the minimum driving state, the correction target misalignment amount may be obtained by setting the weight coefficient of the misalignment of the printing positions in the maximum driving state larger than the weight coefficient of the misalignment of the printing positions in the minimum driving state. On the other hand, regarding the ink which barely finds an opportunity to be driven in the maximum driving state concerning ejection data after image processing, the correction target misalignment amount may be obtained by setting the weight coefficient of the misalignment of the printing positions in the minimum driving state larger than the weight coefficient of the misalignment of the printing positions in the maximum driving state.

Moreover, in the above description, the correction target misalignment amount is obtained based on the misalignment of the printing positions regarding the two states of the maximum driving state and the minimum driving state. However, the correction target misalignment amount may be obtained based on other driving states. Specifically, the correction target misalignment amount may be obtained by way of a weighted average of misalignment of the printing positions resulting from an arbitrary drive frequency that is relatively high and misalignment of the printing positions resulting from another arbitrary drive frequency that is relatively low. The correction target misalignment amount may be appropriately adjusted based on conspicuity of the misalignment of the printing positions, the driving frequency that is used more often, and so forth in such a way that the misalignment of the printing positions of each print head or the color shift between the print heads becomes less conspicuous.

Third Embodiment

In the second embodiment, the misalignment of the printing positions is measured both in the maximum driving state and the minimum driving state regarding each of the print head 3. However, this measurement process requires execution of the temperature adjustment processing and the ejecting operation continually until the heat deformation is stabilized in each of the print heads, thus resulting in consumption of a lot of time and a huge amount of the ink.

Given the situation, the present embodiment is configured to measure the misalignment of the printing positions regarding each print head in the steady state where the heat deformation in the intermediate magnitude, or in other words, the misalignment of the printing positions in the intermediate magnitude between the maximum driving state and the minimum driving state is available, and then to set the correction value for each head based on the misalignment of the printing positions. To be more precise, the thermal expansion at an intermediate level is reproduced by adjusting the temperature of the printing element substrates 10 in the print head 3 to a temperature lower than the temperature (65° C.) set for the ordinary printing operation without driving the printing elements 15. In the following description, the state where the heat deformation at the intermediate level between the maximum driving state and the minimum driving state will be referred to as an intermediate state.

<Method of Reproducing Intermediate State>

Figure 22:
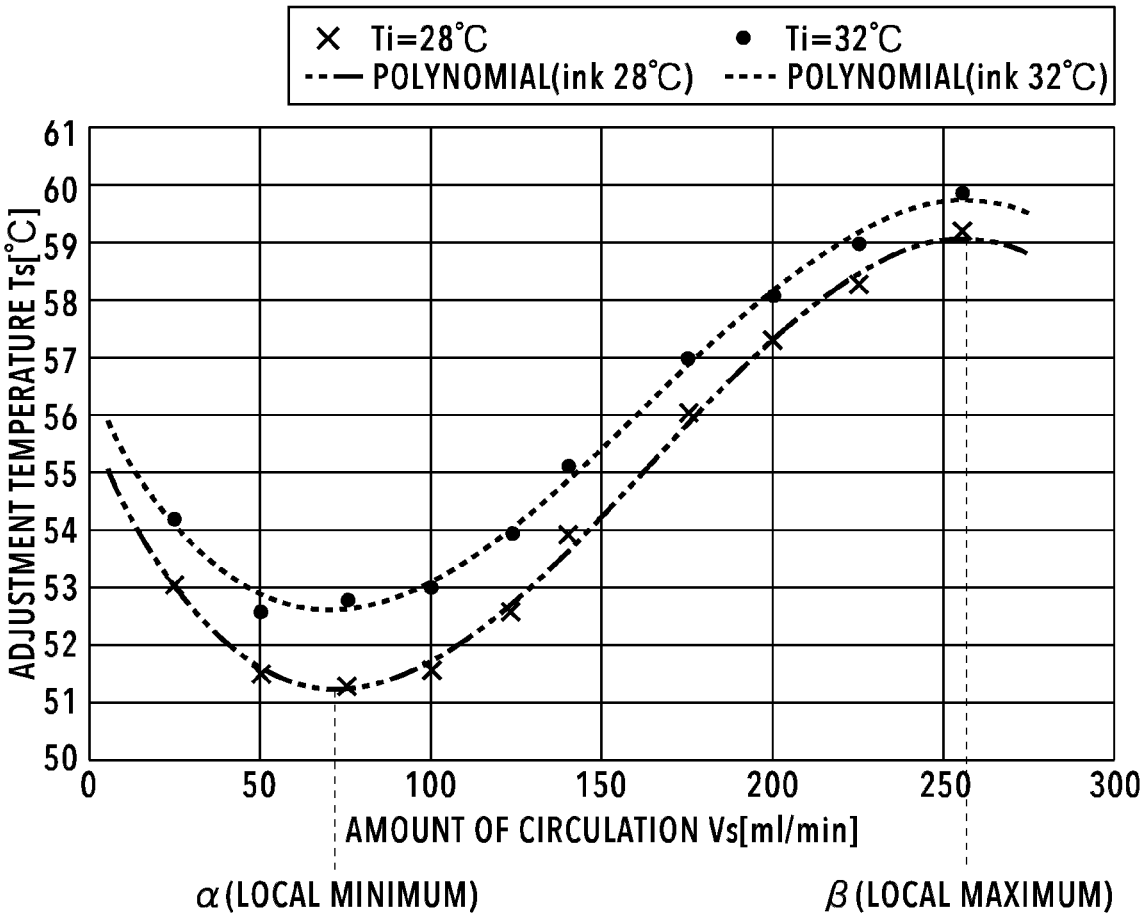
FIG. 22 is a graph showing a relation between an amount of circulation and an adjustment temperature for reproducing an intermediate state.

FIG. 22 is a graph showing a relation between an amount of circulation Vs and an adjustment temperature Ts for reproducing the intermediate state. The horizontal axis indicates the amount of circulation Vs while the vertical axis indicates the adjustment temperature Ts of the printing element substrates 10. In the following description, a total amount of the ink flowing in the printing element substrates 10 arranged in they direction in the print head 3 per unit time will be referred to as the amount of circulation Vs. Meanwhile, a target temperature set to the printing element substrates 10 arranged in the y direction in common and to be adjusted by the temperature sensors 301 and the sub-heaters 302 (see FIG. 2) will be referred to as the adjustment temperature Ts. In the general printing operation, the adjustment temperature is set to 65° C.

FIG. 22 plots the relation between the amount of circulation Vs and the adjustment temperature Ts that can reproduce the intermediate state obtained by thermofluid structure coupled simulation. This relation between the amount of circulation Vs and the adjustment temperature Ts can be approximated by a cubic function having a local minimum α and a local maximum β. FIG. 22 also shows the cubic function obtained as an approximation formula. In the present embodiment, a temperature Ti of the ink flowing in the printing apparatus 1000 is controlled in a range from 28° C. to 32° C. by using a heat exchanger. FIG. 22 shows a case where the ink temperature T is equal to 28° C. and a case where the ink temperature T is equal to 32° C. as graph legends.

Here, a cubic function Ts(Vs) of the adjustment temperature Ts can be expressed by the following general formula by using coefficients a, b, c, and d:

$$Ts(Vs)=aVs^3+bVs^2+cVs+d \quad \text{(Formula 1).}$$

The coefficients a, b, c, and d vary with the ink temperature Ti in the case of (Formula 1). However, values of the coefficients a, b, c, and d cannot be obtained linearly based on the case where the ink temperature Ti is equal to 28° C. and the case where the ink temperature Ti is equal to 32° C. Therefore, in the present embodiment, the following (Formula 2) that employs the local minimum α and the local maximum β is used as the cubic function Ts(Vs) of the adjustment temperature Ts:

$$Ts(Vs) = a\left(Vs - \alpha + \frac{\beta - \alpha}{2}\right)(Vs - \beta)^2 + Ts(\beta). \quad \text{(Formula 2)}$$

The use of (Formula 2) makes it possible to obtain the values of the coefficients a, α, and β linearly based on the case where the ink temperature T is equal to 28° C. and the case where the ink temperature T is equal to 32° C. Here, the coefficients a, α, and β in the case where the ink temperature T is equal to 28° C. and in the case where the ink temperature T is equal to 32° C. are obtained in advance by simulation.

The present embodiment assumes that the coefficients a, α, and β at an arbitrary ink temperature Ti in the range from 28° C. to 32° C. can be calculated by using (Formulae 3) below:

$$a=7.8150e^{-8}Ti-4.7019e^{-6}$$

$$\alpha=-0.35625Ti-337.725$$

$$\beta=-0.4500Ti+84.3000 \quad \text{(Formulae 3).}$$

Specifically, in the present embodiment, the above-mentioned cubic function of an arbitrary one of the print heads 3 can be derived by measuring the temperature Ti of the ink circulated in the printing apparatus 1000 through the relevant print head 3. Then, by using the derived cubic function, it is possible to obtain the adjustment temperature Ts for reproducing the intermediate heat deformation in the print head 3 based on the amount of circulation Vs of the printing element substrate 10.

Next, a description will be given of a method of measuring the amount of circulation Vs.

Figure 23A:
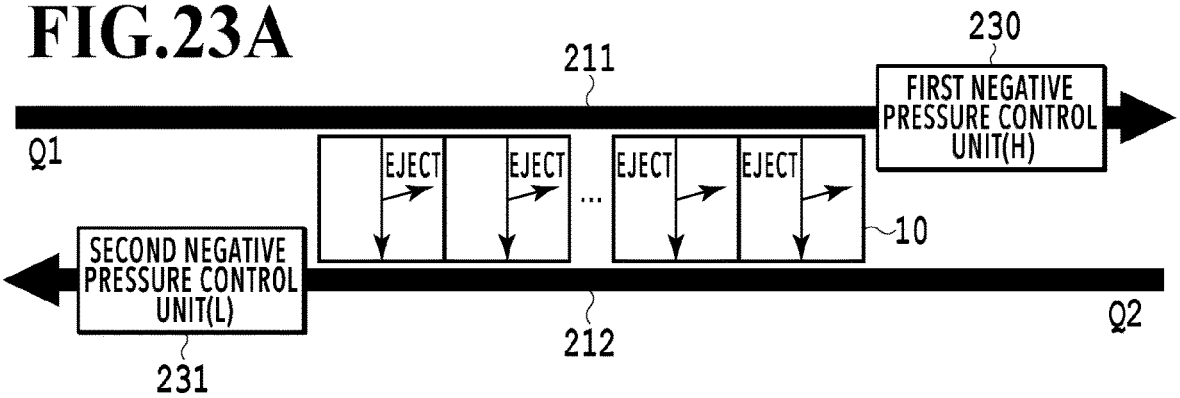
FIGS. 23A to 23C are diagrams showing a relation between the amount of circulation and an ink flow rate in an ejection unit.
Figure 23B:
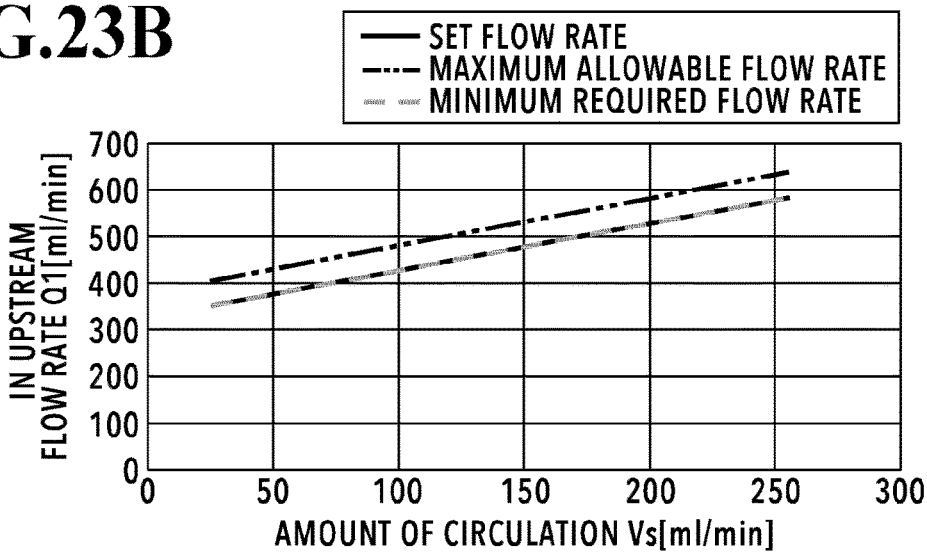
Figure 23C:
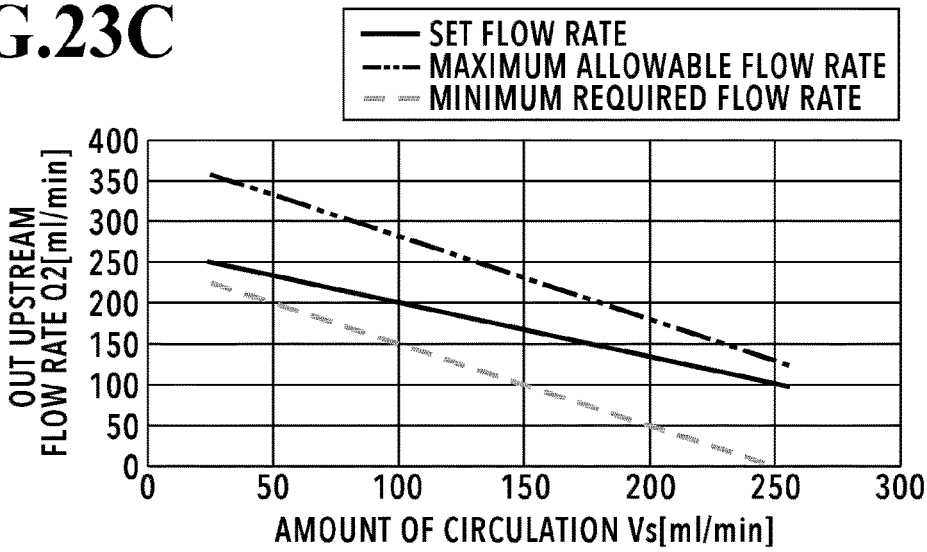

FIGS. 23A to 23C are diagrams for explaining a relation between the amount of circulation Vs and a flow rate of the ink in the ejection unit 300.

FIG. 23A is a diagram schematically showing the ink circulation. The first negative pressure control unit 230 that generates a relatively high pressure is connected to the common supply flow passage 211 while the second negative pressure control unit 231 that generates a relatively low pressure is connected to the common collection flow passage 212. For this reason, a flow directed from the common supply flow passage 211 to the common collection flow passage 212 is generated in each of the printing element substrates 10 and the total flow rate that passes through the printing element substrates 10 becomes the amount of circulation Vs. The amount of circulation Vs is controlled based on tolerances such as a differential pressure created by the first and second negative pressure control unit 230 and 231, liquid viscosity, and flow passage resistance, and is adjusted within a range from 25 to 255 ml/min in the present embodiment.

In the case where the ejecting operation takes place in each of the printing element substrates 10, the ink is assumed to be supplied from the common supply flow passage 211 and from the common collection flow passage 212 to each printing element substrate 10 at a proportion of about 6 to 4 in the present embodiment. Meanwhile, an amount of the ink consumed along with the ejecting operation is assumed to be in a range from 0 to 308 ml/min. Here, the maximum value of 308 ml/min is a value obtained by averaging in consideration of a momentary amount of real consumption of 375 ml/min in a case of driving at the maximum drive frequency as well as a non-ejection period to move to the next page. It is to be noted, however, that these numerical values can be changed as appropriate depending on shapes of the flow passages and other factors.

FIGS. 23B and 23C show a relation between the amount of circulation Vs and an upstream flow rate Q1 of the common supply flow passage 211 and a relation between the amount of circulation Vs and an upstream flow rate Q2 of the common collection flow passage 212, respectively.

The relations between the upstream flowrates Q1 and Q2 and the amount of circulation Vs can be measured by installing flowmeters at four locations on the upstream and downstream of the common supply flow passage 211 and the common collection flow passage 212. To be more precise, the amount of circulation Vs is defined as a difference between measurement values with the two flowmeters installed on the upstream and downstream of the common supply flow passage 211. Likewise, the amount of circulation Vs can also be defined as a difference between measurement values with the two flowmeters installed on the upstream and downstream of the common collection flow passage 212. Alternatively, an average value of these two types of differences may be defined as the amount of circulation Vs.

Each of FIGS. 23B and 23C shows a minimum required flow rate determined by the amount of the ink to be possibly consumed by the printing element substrates 10, a maximum allowable flow rate determined by conditions for normally operating the negative pressure control units, and a set flow rate of the present embodiment as graph legends. Each of the flow rates has a linear relation with the amount of circulation Vs. Specifically, in each print head 3 of the present embodiment, it is possible to adjust the amount of circulation Vs of each printing element substrate 10 by controlling the first to third circulation pumps P1 to P3 described with reference to FIG. 3 while checking values measured with the aforementioned flowmeters. Moreover, it is possible to derive the amount of circulation Vs for each print head 3 from measurement values of the upstream flow rate Q1 of the common supply flow passage 211 of the target print head 3 as well as the upstream flow rate Q2 of the common collection flow passage 212 thereof and based on the graphs in FIGS. 23B and 23C.

Specifically, in the present embodiment, the intermediate state of an arbitrary one of the print heads 3 can be reproduced in accordance with the following procedures. First, the ink temperature Ti and the amount of circulation Vs of the target print head 3 are measured. In this case, the amount of circulation Vs is obtained based on the graphs in FIGS. 23B and 23C while measuring the upstream flow rate Q1 of the common supply flow passage 211 and the upstream flow rate Q2 of the common collection flow passage 212. Next, the cubic function of the target print head 3 is derived in accordance with (Formula 2) and (Formulae 3) while using the measured ink temperature Ti. Then, the adjustment temperature Ts corresponding to the amount of circulation Vs is obtained in accordance with the derived cubic function (see FIG. 22). Lastly, the temperature of each of the printing element substrates 10 in the target print head 3 is adjusted to the adjustment temperature Ts and the operation stands by until the steady state is established. In this way, it is possible to reproduce the intermediate state of the target print head 3, which exhibits the intermediate thermal expansion between the maximum driving state and the minimum driving state.

<Method of Setting Correction Value>

Next, a description will be given of a method of setting the correction value for each of the printing element substrates 10 based on the misalignment of the printing positions obtained under the intermediate state.

Figure 24:
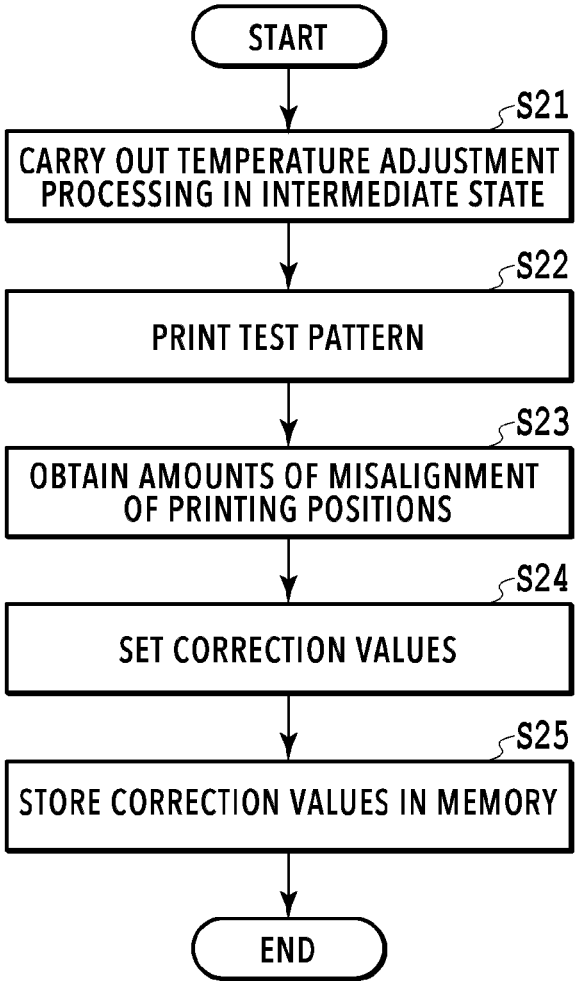
FIG. 24 is a flowchart for explaining the correction processing in a third embodiment.

FIG. 24 is a flowchart for explaining the processing for correcting the misalignment of the printing positions in the present embodiment. The only difference of this flowchart from the flowchart in FIG. 17 described in the first embodiment lies in the temperature adjustment processing in step S21.

In step S21, the control unit 500 carries out the temperature adjustment processing under the intermediate state. To be more precise, the control unit 500 conducts the prescribed circulation control without driving the printing elements 15 after heating the respective printing element substrates 10 of the print head 3 to the adjustment temperature Ts that is obtained in accordance with the above-described method.

Steps S22 to S25 to follow are the same as steps S2 to S5 in FIG. 17, and explanations thereof will be omitted.

In the present embodiment, the correction value for correcting the misalignment of the printing positions in the intermediate state is set in step S24. Accordingly, the same effect as the effect of the second embodiment can be obtained after the correction processing. In other words, the present embodiment can complete the correction processing in a shorter time than the time required by the second embodiment while obtaining the same effect as that of the second embodiment.

Meanwhile, in the case of the second embodiment, the difference in the misalignment of the printing positions between the maximum driving state and the minimum driving state may be hidden by a measurement error in the case of a print head that exhibits just a little deformation in the first place. Hence, it may not be possible to set an appropriate correction target misalignment amount to this print head. The mode of measuring the misalignment of the printing positions in a single driving state as described in the present embodiment makes it possible to obtain the correction target misalignment amount in a more accurate state.

As described above, only the misalignment of the printing positions in the intermediate state is measured according to the present embodiment. In this way, it is possible to suppress the misalignment of the printing positions in each print head 3 and the misalignment of the printing positions between the print heads irrespective of the ejection frequency of each print head, and thus to print a high-quality image.

The case of approximating the adjustment temperature Ts with the cubic function of the adjustment temperature Ts and the amount of circulation Vs has been described above with reference to FIG. 22. However, there may be a case where it is preferable to conduct the approximation by using a function different from the cubic function depending on the assumed circulation control. In any case, any function is applicable as long as it is possible to obtain an approximation function that determines the adjustment temperature Ts with respect to the amount of circulation Vs based on the relation obtained from the simulation or the measurement.

Meanwhile, FIGS. 23B and 23C describe the case in which the upstream flow rate Q1 of the common supply flow passage 211 and the upstream flow rate Q2 of the common collection flow passage 212 change continuously with respect to the amount of circulation Vs, respectively. However, such continuity is not always a prerequisite according to the present embodiment. In the case where the upstream flow rate Q1 of the common supply flow passage 211 or the upstream flow rate Q2 of the common collection flow passage 212 changes discontinuously with respect to the amount of circulation Vs, such a change may be expressed by two or more functions that are discontinuous with one another. In any case, the amount of circulation Vs only needs to be uniquely determined by the measured values of Q1 and Q2.

In the above description, the function of the adjustment temperature Ts and the amount of circulation Vs as shown in FIG. 22 is derived in accordance with (Formulae 3) while associating the function with the ink temperature Ti, and then the adjustment temperature Ts is derived from the amount of circulation Vs by using this function. However, the aforementioned procedures may be reversed. Specifically, a function of the adjustment temperature Ts and the ink temperature Ti may be derived while associating the function with the amount of circulation Vs and then the adjustment temperature Ts may be derived from the ink temperature Ti by using this function.

Furthermore, in the above description, the adjustment temperature Ts corresponding to the ink temperature Ti and the amount of circulation Vs is calculated by using the functional formulae as represented by (Formula 2) and (Formulae 3). Instead, the adjustment temperature Ts may be obtained by referring to a lookup table. In this case, it is appropriate to prepare a three-dimensional lookup table in which the ink temperature Ti, the amount of circulation Vs, and the adjustment temperature Ts are associated with one another in advance. Such a lookup table can be created by actually measuring a relation between the adjustment temperature Ts and the heat deformation of the print head 3 or by conducting the thermofluid structure coupled simulation on such a relation.

Meanwhile, in the above description, the intermediate state in which the intermediate heat deformation is available is reproduced by adjusting the adjustment temperature Ts. In the meantime, this intermediate state can also be reproduced by adjusting a driving condition such as reducing the drive frequency as low as about a half of that in the maximum driving state. In any case, it is possible to set an appropriate correction value to each print head 3 as long as the misalignment of the printing positions can be measured after reproducing the intermediate state in which the intermediate heat expansion is available, thereby achieving the effect of the present embodiment.

Furthermore, as with the second embodiment, the correction target misalignment amount may be adjusted as appropriate for each print head based on the conspicuity of the misalignment of the printing positions, the drive frequency that is used more often, and so forth in the present embodiment as well. It is possible to obtain the effect of the present embodiment as long as the temperature adjustment processing in step S21 is carried out under such a driving condition that can obtain the correction target misalignment amount.

Other Embodiments

The above-mentioned embodiments have described the mode of setting the correction value for each of the printing element substrates. Here, the unit of correction can be changed as appropriate. The correction value may be set in terms of two or more adjacent printing element substrates. Alternatively, the printing element substrates may be divided into several areas and the correction value may be set in terms of each of the areas.

The description has been made above by using the example in which the adjustment temperature Ts of each printing element substrate 10 in the ordinary printing operation is set to 65° C. while maintaining the ink temperature Ti flowing in the printing apparatus 1000 within the range from 28° C. to 32° C. by using the heat exchanger. However, it is possible to change this temperature. Nonetheless, a difference in heat deformation between the print heads attributed to the temperature adjustment processing and the circulation control may not be prominent if the difference between the ink temperature Ti and the adjustment temperature Ts is too small. In order to fully exert the effect of the above-described embodiments, the adjustment temperature Ts in the printing operation is preferably higher by at least 10° C. than the ink temperature Ti.

With reference to FIGS. 15A and 15B, the embodiments have been described as the method of correcting the misalignment of the printing positions in the x direction that may occur due to the difference in temperature of the ink flowing in the common supply flow passage 211 and the common collection flow passage 212. However, in the elongate print head 3 configured to circulate the ink between the printing apparatus 1 and the print head while heating the printing element substrates, the misalignment of the printing positions in the x direction may occur due to a thermal factor other than the foregoing. In any case, it is possible to obtain the effect of reducing the misalignment of the printing positions that is apt to change dynamically by applying the above-described embodiments designed to carry out the correction processing after the thermal expansion of the print head 3 reaches the steady state.

Meanwhile, the above-mentioned embodiments have described the inkjet printing apparatus of a full-line type mounting the four print heads 3 that eject the inks of mutually different colors. However, the above-described printing position correction method can be applied to printing apparatuses of other types. For example, such a printing apparatus may be of a type that includes five or more print heads that eject inks of five or more colors, or of a type that includes a single print head that ejects an ink of one color.

Meanwhile, with reference to FIGS. 4A to 5, the above-mentioned embodiments have described the example of the print head that is compatible with the A3 size as well as the B2 size. However, the length of the print head is not limited to a particular length. Besides, the print head does not always have to be the line-type print head to be mounted on the printing apparatus of the full-line type. In a case of a printing apparatus of a serial type configured to repeat print scanning of a print head and a conveyance operation to convey a print medium in a direction intersecting with the print scanning direction may cause misalignment of the printing positions attributed to heat deformation in a case where the printing apparatus mounts an elongate print head. In this case as well, it is possible to obtain the effect of suppressing the misalignment of the printing positions by setting the correction value for each print head in accordance with any of the above-described embodiments. Nevertheless, the print head preferably has a printing width corresponding to the A3 size or larger in order to obtain the effect of correcting the misalignment of the printing positions associated with the heat deformation.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present disclosure, it is possible to reduce misalignment of printing positions in a print head configured to circulate an ink between a printing apparatus and the print head in a case where the misalignment is apt to change dynamically along with heat deformation.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-182932, filed Oct. 30, 2020, which is hereby incorporated by reference wherein in its entirety.

What is claimed is:

1. A printing position correction method applied to a printing apparatus configured to use a print head including a plurality of printing element substrates in which a plurality of printing elements are continuously arranged in a first direction, and to print an image on a print medium being conveyed in a second direction intersecting with the first direction, the method being designed to correct a printing position in the second direction, comprising:

an obtaining step of adjusting the plurality of printing element substrates in the print head to a target temperature, circulating a liquid through the printing element substrates in the print head, and obtaining an amount of misalignment of printing positions in the second direction of the print head by using a test pattern printed on the print medium being conveyed in the second direction by driving the printing elements in the print head after thermal expansion of the print head reaches a steady state; and a setting step of setting a correction value based on the amount of misalignment of the printing positions.

2. The printing position correction method according to claim 1, wherein the print head includes:

a common supply flow passage configured to supply the liquid to the plurality of printing element substrates in common; and a common collection flow passage configured to collect the liquid from the plurality of printing element substrates in common.

3. The printing position correction method according to claim 1, wherein in the obtaining step, the amount of misalignment of the printing positions is each obtained in a first driving state where the print head reaches a steady state by being driven under a first driving condition and in a second driving state where the print head reaches a steady state by being driven under a second driving condition different from the first driving condition, and in the setting step, a correction target misalignment amount is calculated based on the amount of misalignment of the printing positions in the first driving state and the amount of misalignment of the printing positions in the second driving state, and the correction value is set by using the correction target misalignment amount as a target of correction.

4. The printing position correction method according to claim 3, wherein the correction target misalignment amount is an average value of the amount of misalignment of the printing positions in the first driving state and the amount of misalignment of the printing positions in the second driving state.

5. The printing position correction method according to claim 3, wherein the correction target misalignment amount is a value obtained by weighted averaging of the amount of misalignment of the printing positions in the first driving state and the amount of misalignment of the printing positions in the second driving state.

6. The printing position correction method according to claim 3, wherein the first driving condition is a condition to drive the printing elements in the print head at a maximum driving frequency acceptable by the printing elements, and the second driving condition is any of a condition not to drive the printing elements and a condition to drive the printing elements at a minimum driving frequency to enable a check of the printing positions on the print medium.

7. The printing position correction method according to claim 1, wherein in the obtaining step, an intermediate state in which thermal expansion at an intermediate level between thermal expansion in a first driving state where the print head reaches a steady state by driving the printing elements in the print head at a maximum driving frequency acceptable by the printing elements and thermal expansion in a second driving state where the print head reaches a steady state without driving the printing elements in the print head is reproduced, and the amount of misalignment of the printing positions is obtained in the intermediate state, and in the setting step, the correction value is set by using the amount of misalignment of the printing positions in the intermediate state as a target of correction.

8. The printing position correction method according to claim 7, wherein the intermediate state is reproduced by setting the target temperature to a prescribed temperature lower than a temperature to be set for an ordinary printing operation.

9. The printing position correction method according to claim 8, wherein the prescribed temperature is derived from any of a function and a lookup table, each defining a relation among the prescribed temperature, an amount of circulation of the liquid circulated in the plurality of printing element substrates, and a temperature of the liquid circulated in the printing apparatus.

10. The printing position correction method according to claim 7, wherein the intermediate state is reproduced by driving the printing elements in the print head at a frequency lower than a maximum driving frequency acceptable by the printing elements.

11. The printing position correction method according to claim 1, wherein the correction value is set in the setting step in terms of each of the plurality of printing element substrates or in terms of two or more of the adjacent printing element substrates.

12. The printing position correction method according to claim 1, wherein the correction value is set in the setting step in terms of each of areas included in the printing element substrates.

13. The printing position correction method according to claim 1, wherein the correction value represents a shift amount from a standard value of timing to drive the printing elements.

14. The printing position correction method according to claim 1, wherein the print head is a line-type print head having a printing width in the first direction being equal to or larger than a width of an A3 size.

15. The printing position correction method according to claim 1, wherein the print head causes film boiling in the liquid by applying a pulse voltage to each of the printing elements and ejects the liquid by using growth energy of a generated bubble.

16. The printing position correction method according to claim 1, wherein a temperature of the printing element substrates to be adjusted for carrying out a printing operation is higher by at least 10° C. than a temperature of the liquid before being supplied to the print head.

17. The printing position correction method according to claim 1, further comprising:

a step of storing the correction value set in the setting step into a storage unit.

18. A printing apparatus comprising:

a print head including a plurality of printing element substrates in which a plurality of printing elements are continuously arranged in a first direction;

a temperature adjustment unit configured to adjust a temperature of the printing element substrates in the print head;

a circulation unit configured to circulate a liquid in the printing element substrates in the print head;

a driving unit configured to drive the plurality of printing elements in the print head to cause the printing elements to eject the liquid;

a conveyance unit configured to convey a print medium in a second direction intersecting with the first direction;

an obtaining unit configured to obtain an amount of misalignment of printing positions in the second direction of the print head by using a test pattern printed on the print medium being conveyed by the conveyance unit by causing the driving unit to drive the printing elements in the print head after the temperature adjustment unit adjusts the printing element substrates in the print head to a target temperature, the circulation unit circulates the liquid through the printing element substrates in the print head, and thermal expansion of the print head reaches a steady state; and a setting unit configured to set a correction value based on the amount of misalignment of the printing positions.

19. A non-transitory computer-readable storage medium storing a program for causing a computer to execute a printing position correction method, the printing position correction method comprising:

an obtaining step of adjusting the plurality of printing element substrates in the print head to a target temperature, circulating a liquid through the printing element substrates in the print head, and obtaining an amount of misalignment of printing positions in the second direction of the print head by using a test pattern printed on the print medium being conveyed in the second direction by driving the printing elements in the print head after thermal expansion of the print head reaches a steady state; and a setting step of setting a correction value based on the amount of misalignment of the printing positions.

* * * * *